US010119219B2

(12) United States Patent
Lee et al.

(10) Patent No.: US 10,119,219 B2
(45) Date of Patent: Nov. 6, 2018

(54) LAUNDRY TREATING APPARATUS

(71) Applicant: LG ELECTRONICS INC., Seoul (KR)

(72) Inventors: Changheon Lee, Seoul (KR); Jaeseok Kim, Seoul (KR); Incheol Kang, Seoul (KR); Soowon Park, Seoul (KR); Hyuntae Lee, Seoul (KR); Inho Hwang, Seoul (KR); Hyeokjong Lee, Seoul (KR); Kihyuk Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 4 days.

(21) Appl. No.: 15/119,342

(22) PCT Filed: Mar. 20, 2015

(86) PCT No.: PCT/KR2015/002770
§ 371 (c)(1),
(2) Date: Aug. 16, 2016

(87) PCT Pub. No.: WO2015/142122
PCT Pub. Date: Sep. 24, 2015

(65) Prior Publication Data

US 2017/0009392 A1 Jan. 12, 2017

(30) Foreign Application Priority Data

Mar. 21, 2014 (KR) ..... 10-2014-0033179
Mar. 21, 2014 (KR) ..... 10-2014-0033180
Mar. 21, 2014 (KR) ..... 10-2014-0033181

(51) Int. Cl.
*A47B 95/00* (2006.01)
*D06F 39/14* (2006.01)
(Continued)

(52) U.S. Cl.
CPC ..... *D06F 39/14* (2013.01); *D06F 37/10* (2013.01); *D06F 37/28* (2013.01); *D06F 58/20* (2013.01)

(58) Field of Classification Search
CPC ..... D06F 37/28; D06F 37/10; D06F 39/14; D06F 39/12; D06F 58/20; E05D 7/02;
(Continued)

(56) References Cited

U.S. PATENT DOCUMENTS 4,035,953 A 7/1977 Bierlich
5,829,197 A 11/1998 Oh
(Continued)

FOREIGN PATENT DOCUMENTS

CN 1766206 5/2006
CN 103314151 9/2013
(Continued)

OTHER PUBLICATIONS

European Search Report dated Aug. 14, 2017 issued in Application No. 15764928.6.
(Continued)

*Primary Examiner* — Daniel J Troy
*Assistant Examiner* — Timothy M Ayres
(74) *Attorney, Agent, or Firm* — KED & Associates, LLP

(57) ABSTRACT

A laundry treating apparatus comprises a cabinet forming a profile, provided with a laundry opening; a door having an inner frame arranged toward the laundry opening and an outer frame coupled to the inner frame and arranged toward the outside of the cabinet, and opening and closing the laundry opening; a hinge part having a first pivot rotating the door along a first rotational direction and a second pivot rotating the door along a second rotational direction different from the first rotational direction; a pivot switching member movable to rotatably fix the door to any one of the first pivot
(Continued)

and the second pivot; and a pressing piece provided in the door and pressed by a user to move the pivot switching member, wherein the pressing piece includes a pressing point pressed by the user, and the pressing point is provided at an upper end of the pressing piece.

15 Claims, 17 Drawing Sheets

(51) Int. Cl.
*D06F 58/20* (2006.01)
*D06F 37/10* (2006.01)
*D06F 37/28* (2006.01)

(58) Field of Classification Search
CPC ..... E05D 7/1044; E05D 7/12; E05D 15/52; E05B 5/00
USPC ..... 312/228, 332.1; 292/336.3; 16/110.1, 16/412, 415, 111.1
See application file for complete search history.

(56) References Cited

U.S. PATENT DOCUMENTS

| | | | | |
|---|---|---|---|---|
| 7,984,955 | B2 * | 7/2011 | Jung | F25D 23/028 312/405 |
| 8,820,861 | B2 * | 9/2014 | Kim | D06F 39/14 312/228 |
| 8,936,330 | B2 * | 1/2015 | Kim | E05D 3/10 312/298 |
| 9,435,068 | B2 * | 9/2016 | Kang | D06F 39/14 |
| 9,441,872 | B2 * | 9/2016 | Park | F25D 11/02 |
| 9,650,737 | B2 * | 5/2017 | Lee | D06F 37/28 |
| 9,790,633 | B2 * | 10/2017 | Lee | D06F 37/28 |
| 2006/0086151 | A1 | 4/2006 | Kim et al. | |
| 2008/0172838 | A1 | 7/2008 | Choi | |

FOREIGN PATENT DOCUMENTS

| | | |
|---|---|---|
| CN | 103328712 | 9/2013 |
| CN | 104846600 | 8/2015 |
| EP | 1 486 604 | 12/2004 |
| EP | 2 657 393 | 10/2013 |
| EP | 2 907 912 | 8/2015 |
| KR | 10-2013-0071844 | 7/2013 |
| WO | WO 2004/099484 | 11/2004 |

OTHER PUBLICATIONS

Chinese Office Action dated Jun. 1, 2017 issued in Application No. 201580012672.7 (with English translation).
Chinese Office Action dated Jan. 12, 2018 issued in Application No. 201580012672.7 (with English translation).
International Search Report and Written Opinion dated Jun. 25, 2015 issued in Application No. PCT/KR2015/002770 (Full English text).

* cited by examiner

[Fig. 1]
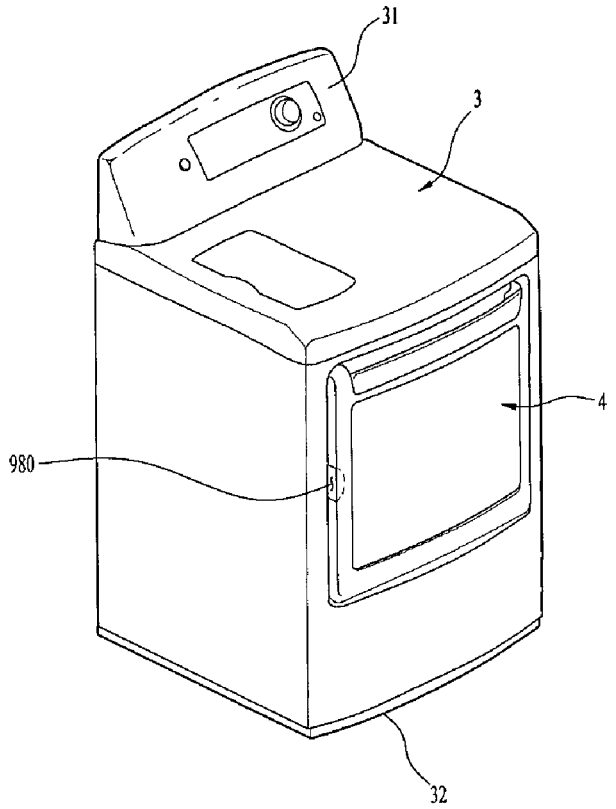

[Fig. 2]
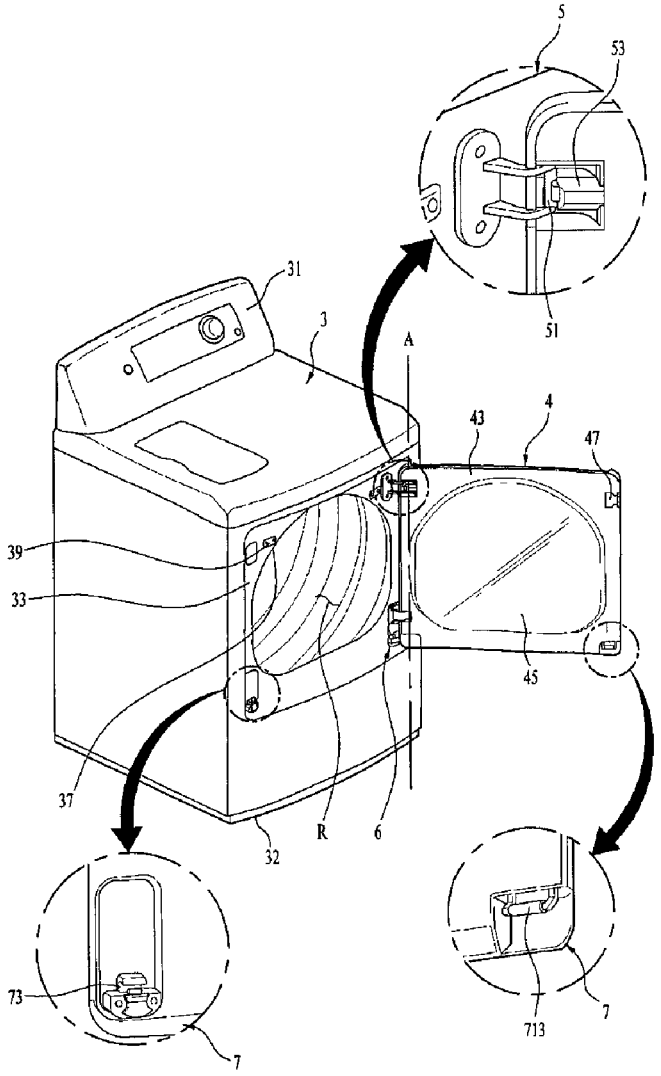

[Fig. 3]
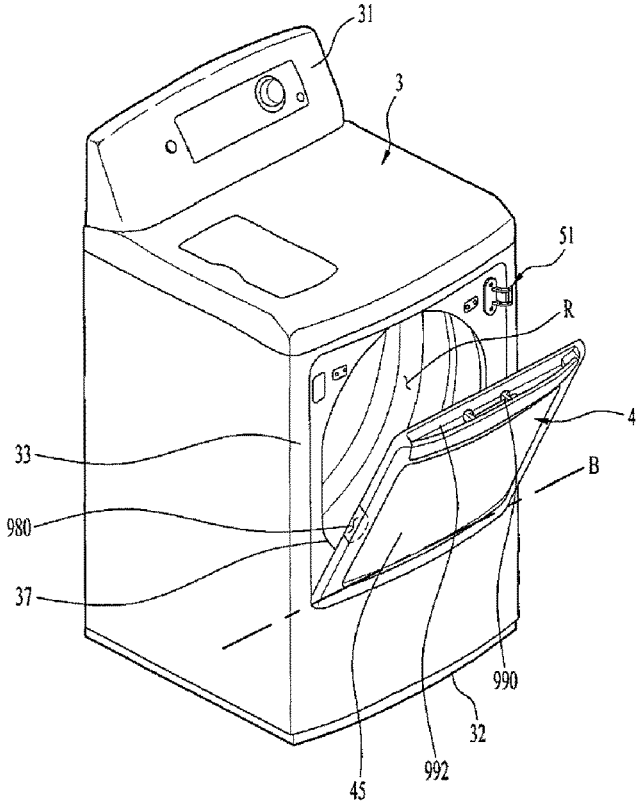
[Fig. 4]
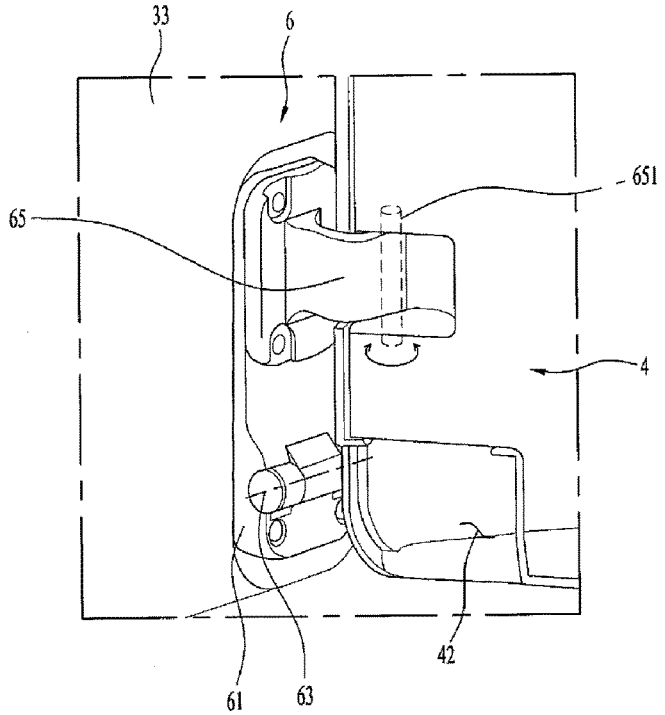

[Fig. 5]
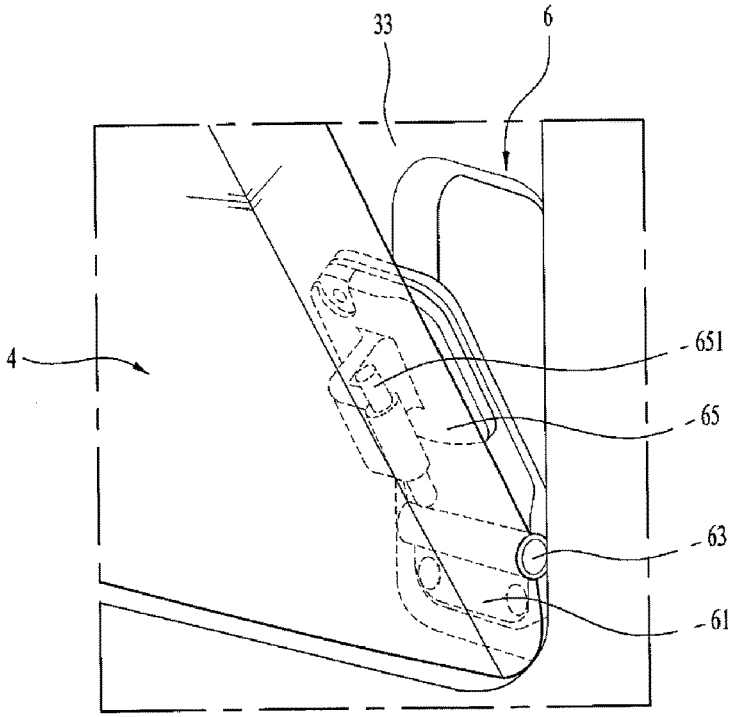
[Fig. 6]
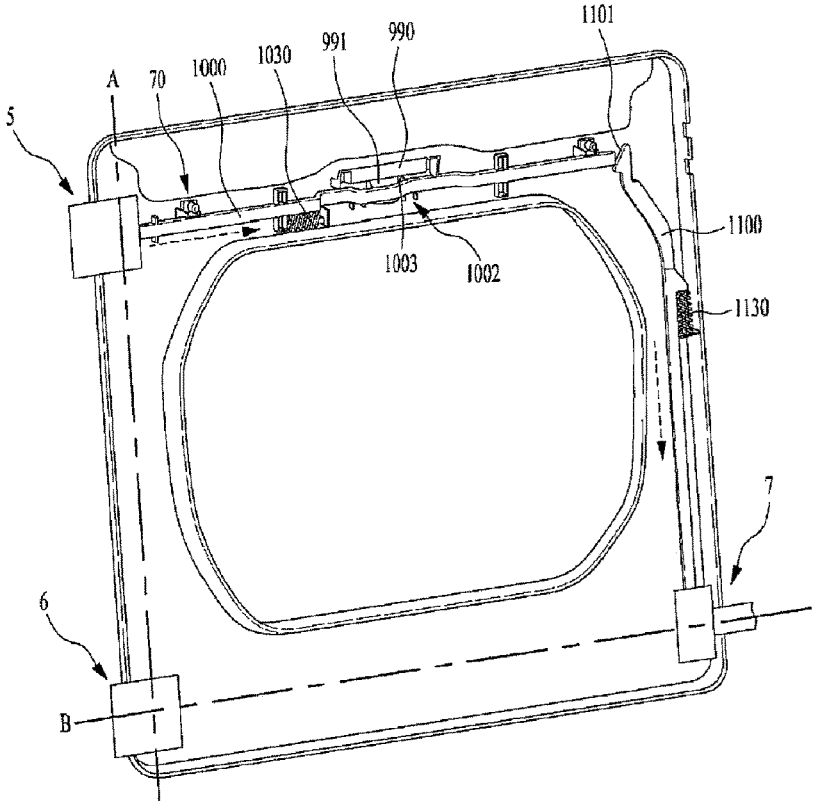

[Fig. 7]
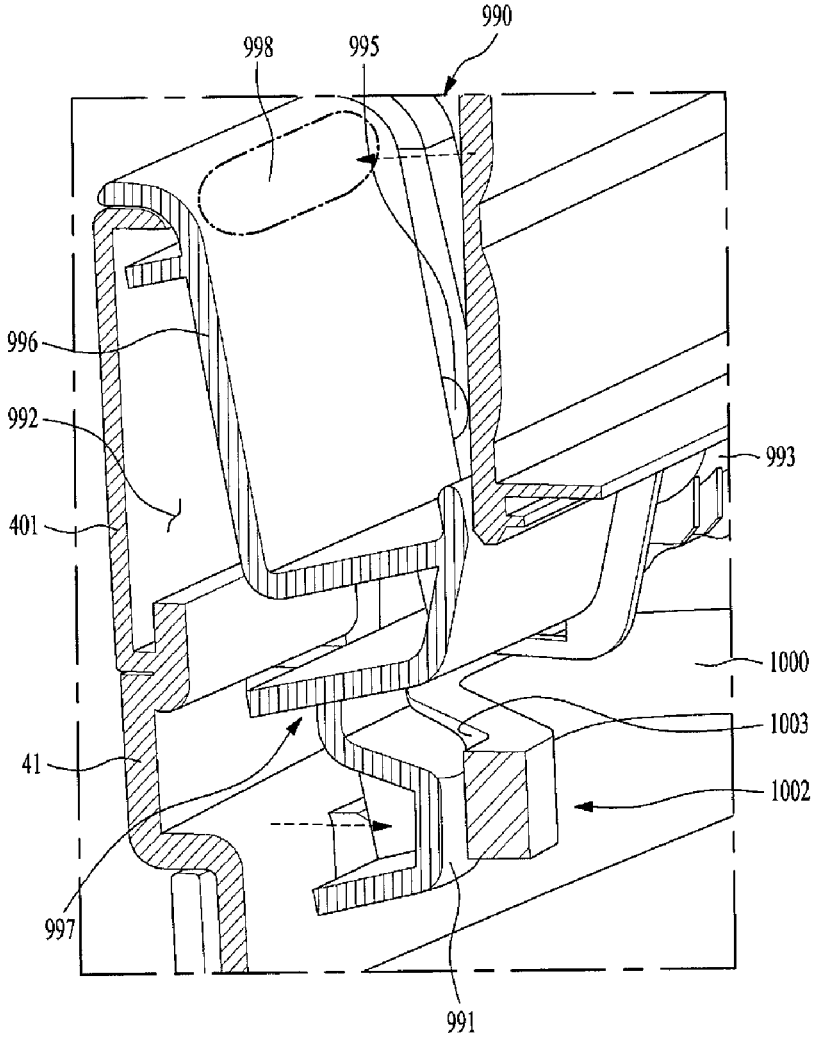

[Fig. 8]
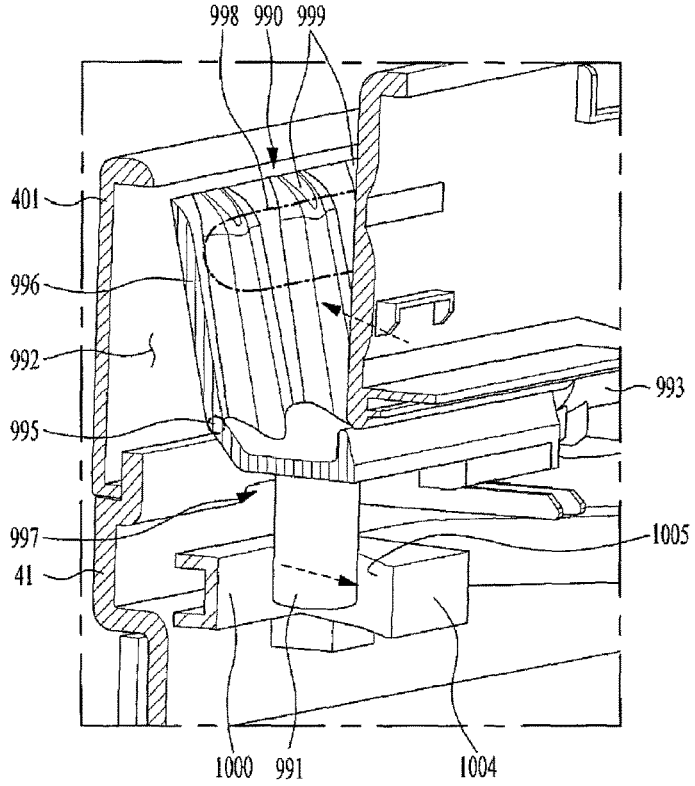
[Fig. 9]
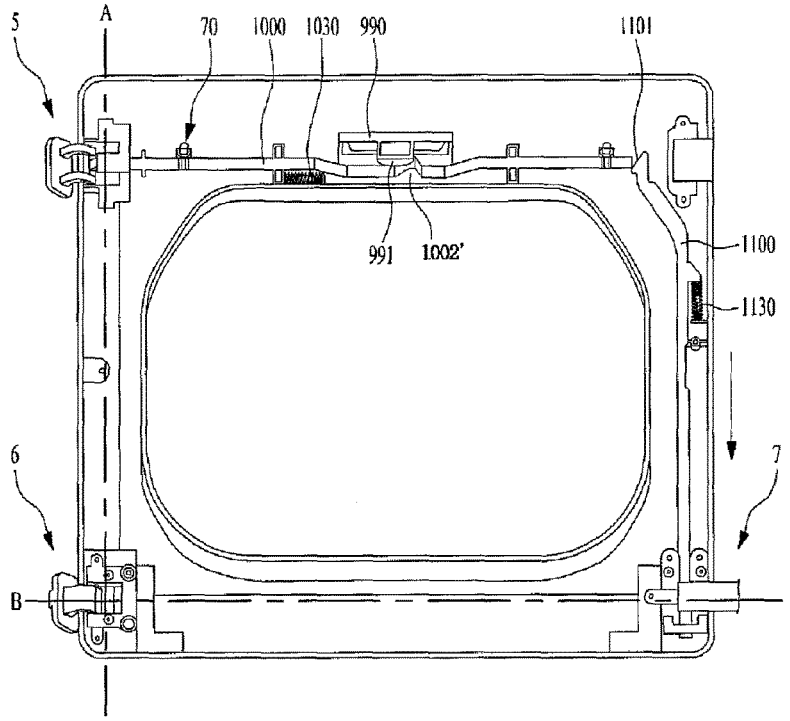

[Fig. 10]
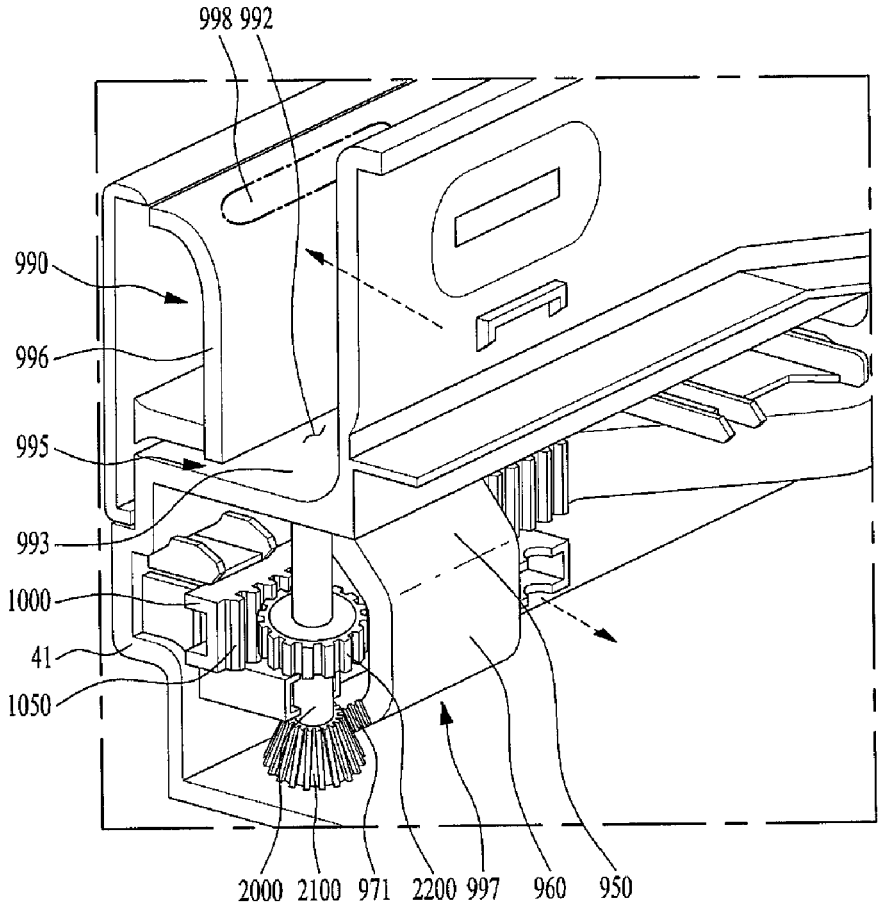

[Fig. 11]
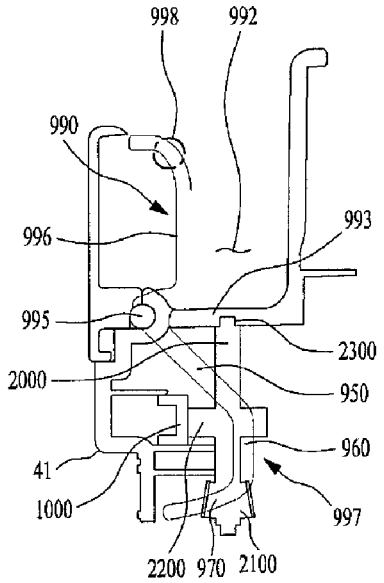
(a)
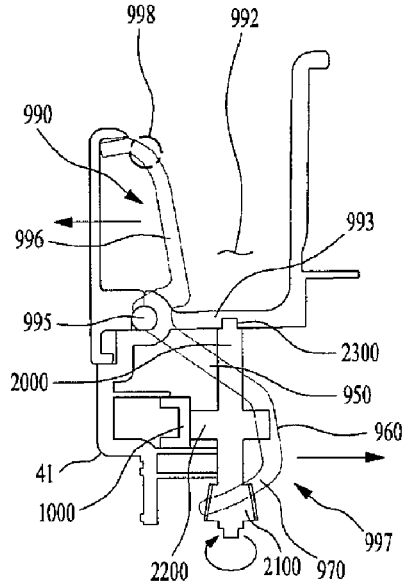
(b)

[Fig. 12]
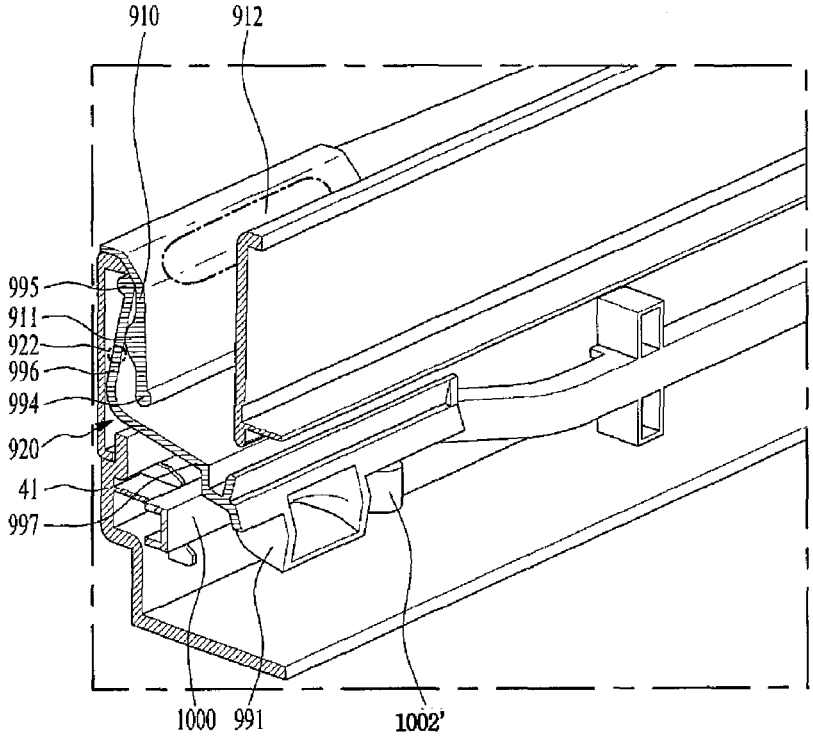
[Fig. 13]
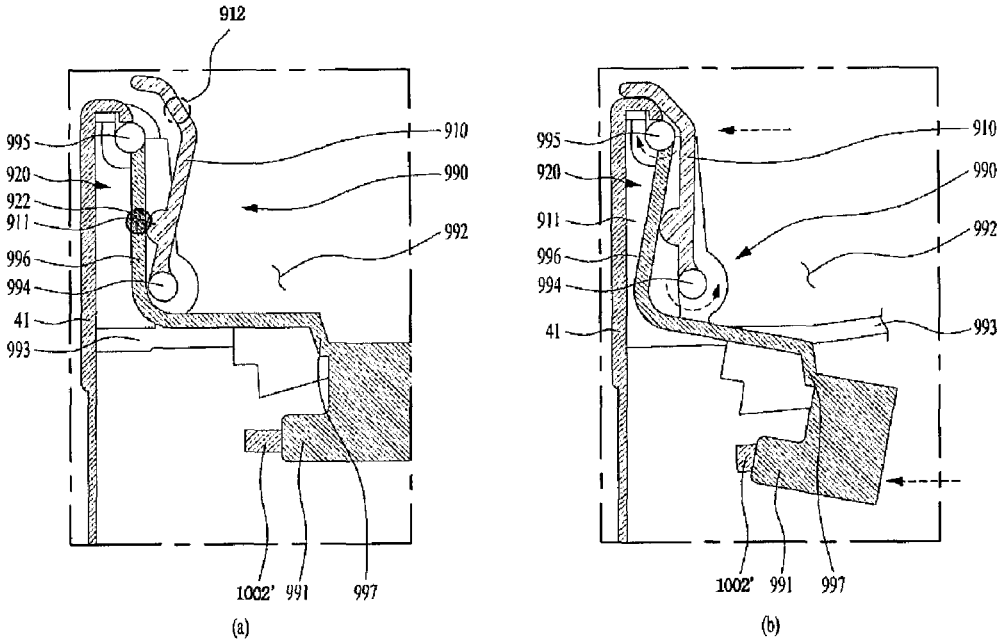

[Fig. 14]
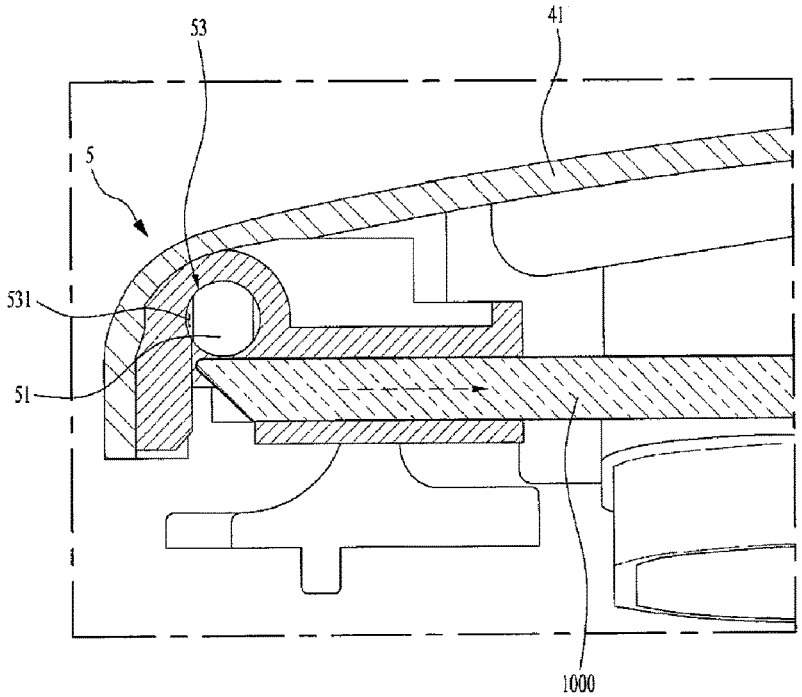
[Fig. 15]
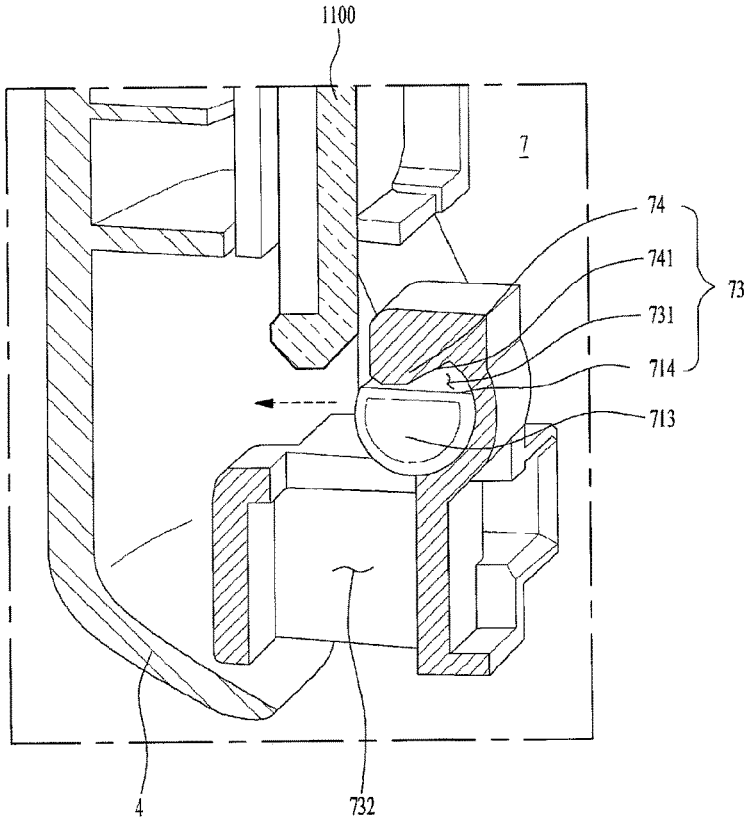

[Fig. 16]
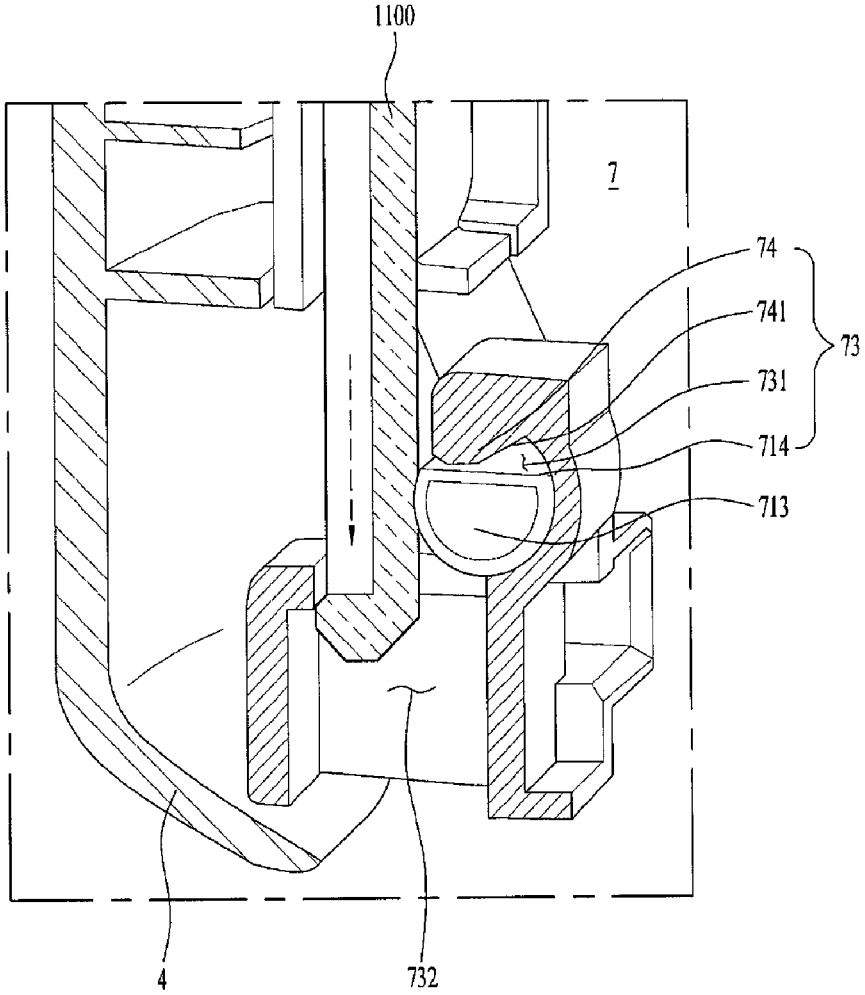

[Fig. 17]
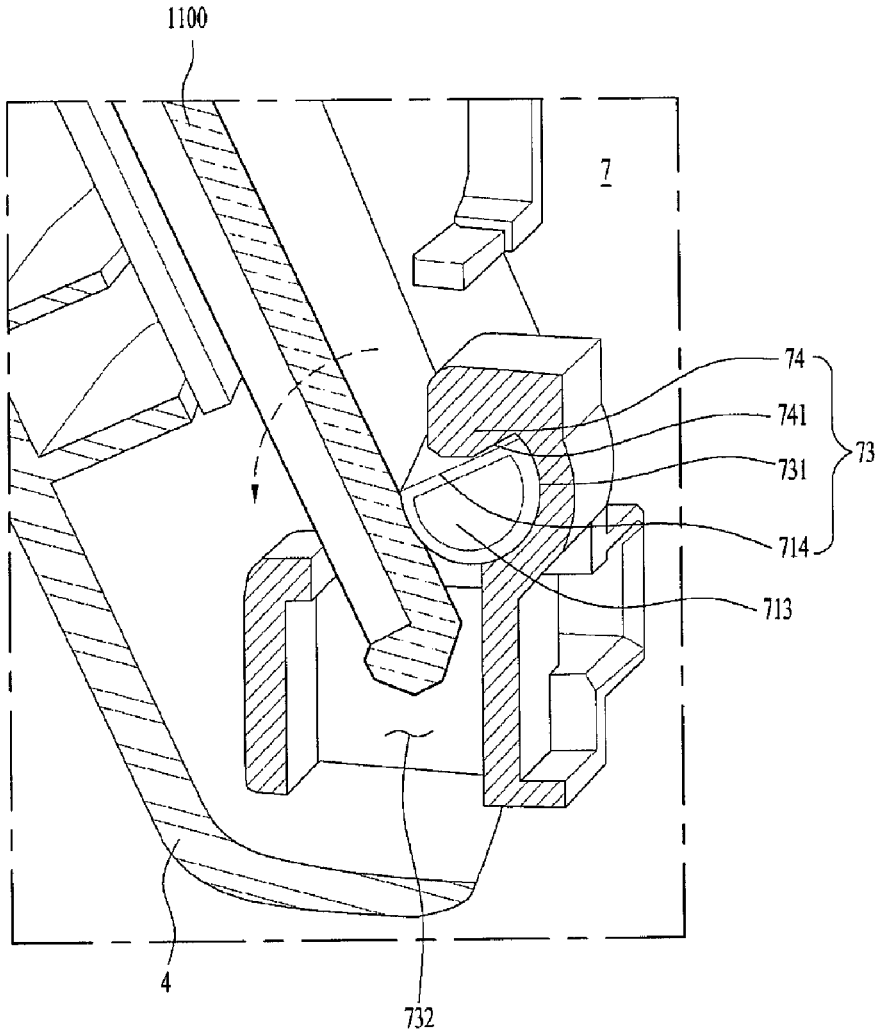

[Fig. 18]
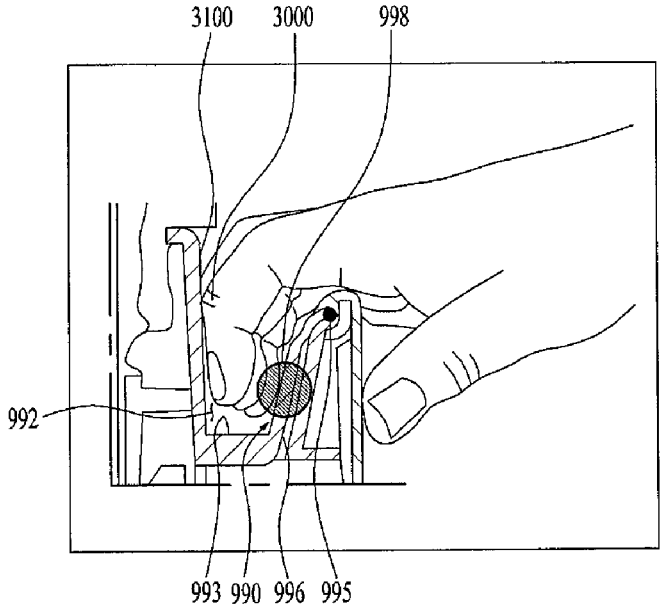
(a)
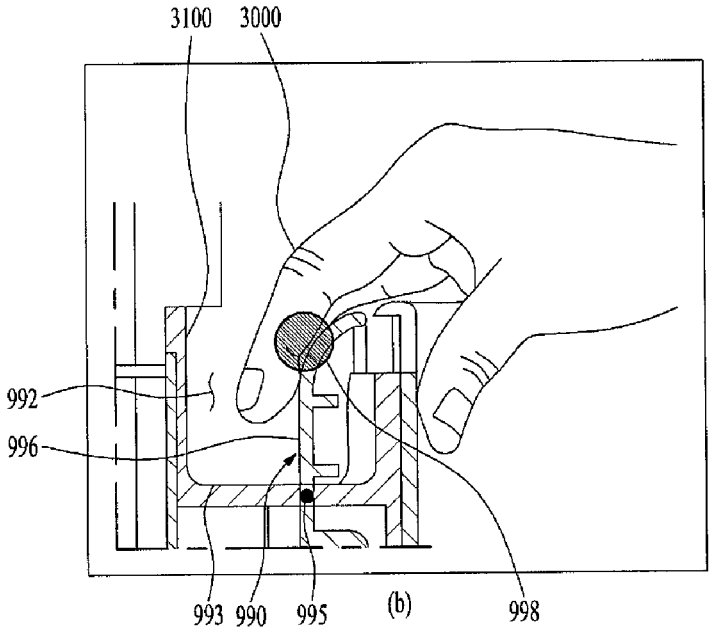
(b)

[Fig. 19]
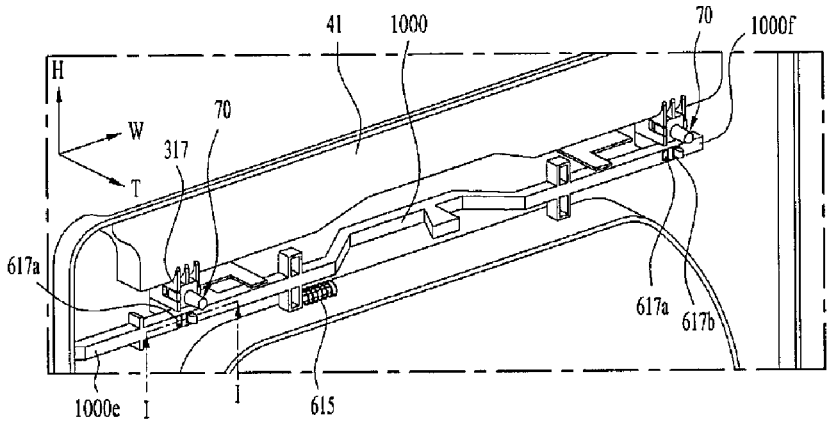
(a)
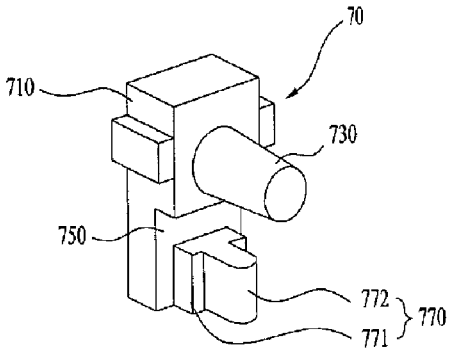
(b)

[Fig. 20]
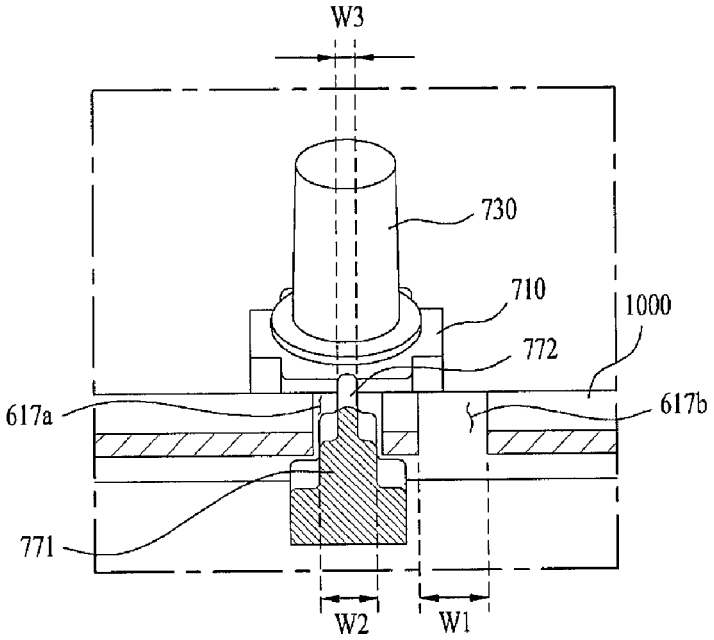
(a)
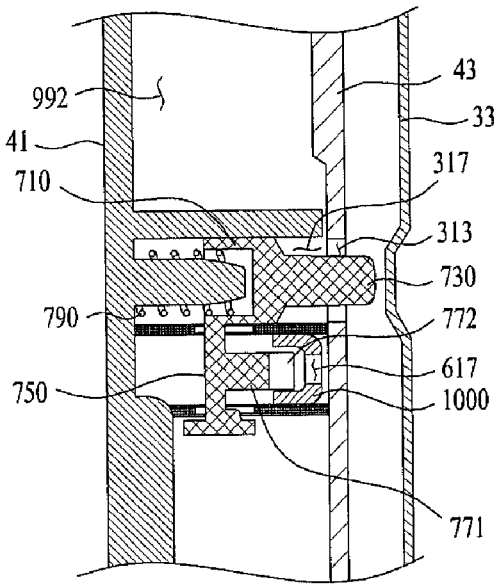
(b)

[Fig. 21]
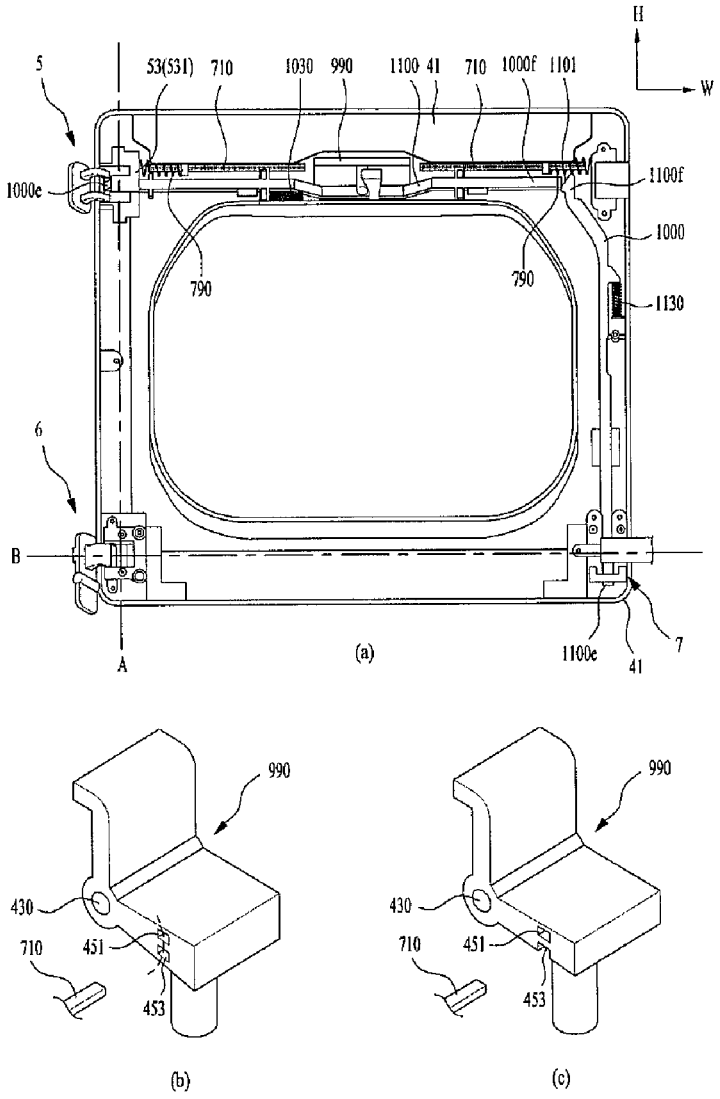

[Fig. 22]
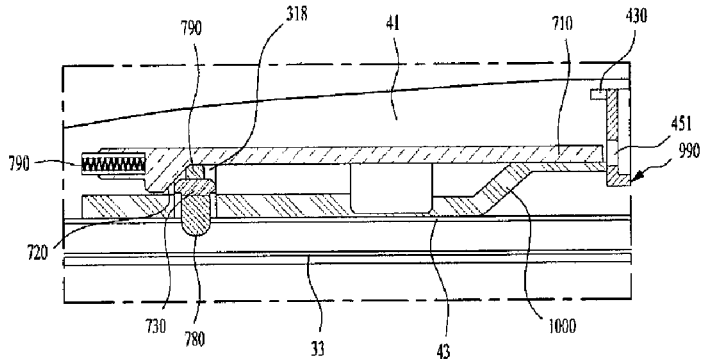
(a)
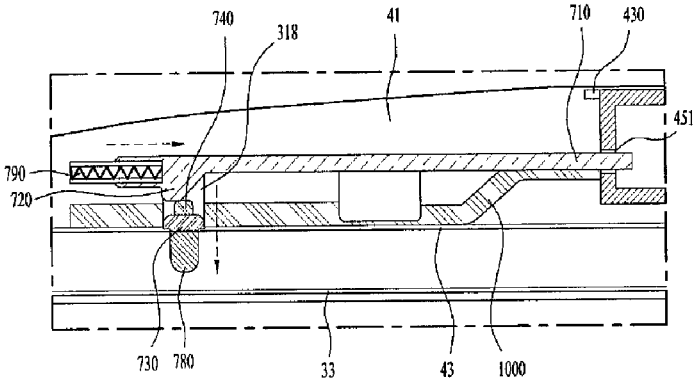
(b)

LAUNDRY TREATING APPARATUS

CROSS-REFERENCE TO RELATED PATENT APPLICATIONS

This application is a U.S. National Stage Application under 35 U.S.C. § 371 of PCT Application No. PCT/KR2015/002770, filed on Mar. 20, 2015, which claims priority to Korean Patent Application Nos. 10-2014-0033181, filed Mar. 21, 2014, 10-2014-0033179, filed on Mar. 21, 2014 and 10-2014-0033180, filed on Mar. 21, 2014 whose entire disclosures are hereby incorporated by reference.

TECHNICAL FIELD

The present invention relates to a laundry treating apparatus, and more particularly, to a laundry treating apparatus in which a door for opening and closing a laundry opening for loading of laundry may be opened rotatably in various directions.

BACKGROUND ART

A laundry treating apparatus may be categorized into a washing-only apparatus only having a washing function, a drying-only apparatus only having a drying function and a laundry washing/drying apparatus having both of the washing and drying functions. Each of the washing-only apparatus and the laundry washing/drying apparatus may include a tub provided in a cabinet and a drum rotatably provided in the tub, and the drying-only apparatus may include a drum rotatably provided in a cabinet.

In a conventional laundry treating apparatus, a laundry opening for loading of the laundry is formed at the front of a body of the laundry treating apparatus, and a door may be installed to open and close the laundry opening. Also, the door may open and close the laundry opening while rotating along a horizontal direction (that is, left and right direction) or vertical direction (that is, up and down direction) when facing the front of the laundry treating apparatus.

A structure of a door that may open and close a laundry opening of a laundry treating apparatus by rotating along a horizontal direction and vertical direction in accordance with a selection of a user is already known. In such an open-close structure of the door, if a user sets a rotational shaft of the door to a horizontal rotational shaft by pressing an actuator provided in a recess at an upper end of the door, the laundry opening may be opened and closed by rotation of the door in a vertical direction.

According to the conventional laundry treating apparatus, as shown for example in Korean Patent Application No. 2011-0139295, a pressing point of the actuator pressed by the user is arranged to be lower than a pivot shaft of the actuator. In more detail, in the conventional laundry treating apparatus, the pressing point of the actuator is arranged near the bottom of the recess provided at the upper end of the door, and the pivot shaft of the actuator is spaced apart from the bottom of the recess to be farther than the pressing point.

Accordingly, the user should use an end knuckle (that is, first knuckle) or fingertip to press the pressing point of the actuator. In this case, a force for pressing the pressing point of the actuator should be focused on the end knuckle or fingertip, and there may be a risk that nails may be broken in case of a woman user.

Also, in the conventional treating apparatus, a direction for pressing the pressing point of the actuator is not the same as a direction for pulling the door. Accordingly, in order to open the door by rotating the door along a vertical direction, the user should pull the door toward his/her body after pressing the pressing point of the actuator. In other words, a problem occurs in that the user should apply a force to the door in two directions (that is, direction for pressing the pressing point of the actuator and direction for pulling the door toward the body of the user) to rotate the door along a vertical direction.

DISCLOSURE OF INVENTION

Technical Problem

The present invention is directed to a laundry treating apparatus that substantially obviates one or more problems due to limitations and disadvantages of the related art. An object of the present invention is to provide a laundry treating apparatus in which a pressing point of an actuator is arranged to be higher than a pivot shaft to allow a user to easily press the pressing point.

Another object of the present invention is to provide a laundry treating apparatus in which a pressing point of an actuator provided in a door may be pressed using a middle knuckle of a user.

Still another object of the present invention is to provide a laundry treating apparatus in which a force is applied to a pressing point of an actuator and a door in a direction toward a body of a user to open and close the door in a vertical direction.

Further still another object of the present invention is to provide a laundry treating apparatus in which a rotation shaft is prevented from being changed during rotation of a door, whereby the door may be rotated stably.

Solution to Problem

To achieve these objects and other advantages and in accordance with the purpose of the invention, a laundry treating apparatus comprises a cabinet forming a profile, provided with a laundry opening; a door having an inner frame arranged toward the laundry opening and an outer frame coupled to the inner frame and arranged toward the outside of the cabinet, and opening and closing the laundry opening; a hinge part having a first pivot rotating the door along a first rotational direction and a second pivot rotating the door along a second rotational direction different from the first rotational direction; a pivot switching member movable to rotatably fix the door to any one of the first pivot and the second pivot; and an actuator provided in the door and pressed by a user to move the pivot switching member, wherein the actuator includes a pressing point pressed by the user, and the pressing point is provided at an upper end of the actuator.

In this case, the door may include a recessed part provided at an upper end of the door and recessed as much as a predetermined depth along a horizontal extension direction of the door, the actuator may include a first portion arranged in the recessed part and pressed by the user, a second portion extended from an end of the first portion toward a space below a bottom of the recessed part, and a pivot shaft provided between the first portion and the second portion, and the pressing point may be arranged to be higher than the pivot shaft.

Also, the pivot switching member may be provided with an inclined surface for moving the pivot switching member in accordance with pressurization of the actuator, and when the first portion of the actuator is pressed, the second portion may be moved in an opposite direction of the pressed direction of the first portion.

Also, a pressing portion projected toward the inner frame may be formed at one end of the second portion of the actuator, the pivot switching member may be provided with a bent portion bent to surround at least a part of the pressing portion, and the inclined surface may be formed at one side of the bent portion and arranged to be in contact with the pressing portion.

Also, the bent portion may be formed to surround at least a part of the pressing portion in a horizontal direction.

Meanwhile, according to another embodiment of the present invention, the actuator may include a pressing portion downwardly extended toward an inner side of the door, the pivot switching member may be provided with a projection projected toward the inner frame, and the inclined surface may be formed at one side of the projection and arranged in contact with the pressing portion.

In this case, the pressing portion may be formed in a cylindrical shape.

Also, the projection may be tapered such that its horizontal width becomes great if it is far away from the pivot switching member.

Also, when the first portion of the actuator is pressed, the second portion may be moved in an opposite direction of the pressed direction of the first portion.

Also, when the first portion of the actuator is pressed, at least a part of the outer frame arranged in the pressed direction of the actuator may be formed to be rotated in the pressed direction of the actuator.

Also, the actuator may be provided with a plurality of ribs spaced apart from one another at predetermined intervals, so as to be grasped by a finger of the user.

Also, the pivot switching member may include a first switching member movable along a width direction of the door and a second switching member movable along a height direction of the door, and the first switching member may be arranged between the outer frame and the second portion of the actuator.

Meanwhile, according to another embodiment of the present invention, first gear teeth may be formed at one side of the pivot switching member, and second gear teeth may be formed at one side of the second portion of the actuator such that a dynamic force based on pressurization of the first portion of the actuator may be transferred to the first gear teeth of the pivot switching member.

Also, the laundry treating apparatus may further comprise a vertical beam rotatably coupled to a groove formed below the recessed part and extended downwardly; a first gear coupled to an end of the vertical beam, interacting with rotation of the vertical beam; and a second gear coupled to a middle part of the vertical beam, interacting with rotation of the vertical beam, wherein the second gear teeth may be engaged with the first gear.

In this case, the first gear teeth formed in the pivot switching member and the second gear may be engaged with each other in a rack pinion type.

Also, if the first portion of the actuator is pressed, the second gear teeth formed at the side of the second portion of the actuator may rotate the first gear and the vertical beam, and the second gear coupled to the vertical beam may move the pivot switching member in a horizontal direction while being engaged with the first gear teeth formed in the pivot switching member.

Also, the pivot switching member may include a first switching member movable along a width direction of the door and a second switching member movable along a height direction of the door, the first gear teeth may be formed at one side of the first switching member along a longitudinal direction of the first switching member, and the dynamic force based on pressurization of the first portion of the actuator may be transferred to the first switching member through the second gear teeth formed at one side of the second portion of the actuator.

Also, the second portion of the actuator may include a first extension portion extended from the space below the bottom of the recessed part toward the inner frame of the door, a second extension portion extended from the first extension portion to a lower direction, and a third extension portion extended from the second extension portion toward the outer frame of the door.

In this case, the second gear teeth may be formed at a side of the third extension portion.

Meanwhile, according to further still another embodiment of the present invention, the actuator may include a first actuator formed to be pressed by the user, and a second actuator formed to be pressed by the first actuator.

Also, the first actuator may be formed to pivot around a first pivot shaft, and the second actuator may include a first portion arranged in the recessed part formed at the upper end of the door and a second portion extended from the end of the first portion to the space below the bottom of the recessed part.

At this time, the second actuator may pivot around a second pivot shaft when it is pressed by the first actuator, so as to move the pivot switching member.

Also, the first pivot shaft may be provided at a lower end of the first actuator, and the second pivot shaft may be provided at an upper end of the second actuator.

Also, the first pivot shaft of the first actuator may be arranged to be lower than the second pivot shaft of the second actuator.

Also, the first actuator may be provided with a projection projected toward the first portion of the second actuator, and the first portion of the second actuator may be pressed by the projection when the first actuator is pressed.

At this time, the projection may be fixed to the first portion of the second actuator.

Also, when the first actuator is pressed, a free end of the second portion of the second actuator may be moved in the same direction as the pressed direction of the first actuator.

Also, the door may include an inner frame arranged toward the laundry opening and an outer frame coupled to the inner frame and arranged toward the outside of the cabinet, and the pressing portion bent toward the outer frame may be provided at the free end of the second portion of the second actuator.

Also, the pivot switching member may include a first switching member movable along a width direction of the door and a second switching member movable along a height direction of the door, and the pressing portion may be formed to be projected toward an inclined surface of a projection piece formed in the first switching member.

Meanwhile, the laundry treating apparatus according to the embodiments of the present invention may further comprise a lock for restricting a motion of the pivot switching member.

In this case, the pivot switching member may include a first switching member extended along a horizontal direction and a second switching member extended from one end of the first switching member to a vertical direction, fixing the fourth shaft to the cabinet selectively rotatably, and the lock may fix a position of at least one of the first switching member and the second switching member.

Also, the laundry treating apparatus may further comprise first and second securing parts provided to be space apart from each other at a predetermined distance along a moving direction of the first switching member or moving direction of the second switching member, such that the lock may detachably be coupled to the first and second securing parts, and the lock may be coupled to any one of the first switching member and the second switching member if the door opens the laundry opening and may fix a position of at least one of the first switching member and the second switching member.

Advantageous Effects of Invention

According to the present invention, since a pressing point of an actuator provided in a door may be pressed using an entire area of a middle knuckle of a user, the actuator may be pressed by the smaller force to rotate the door along a second rotational direction.

Also, in case of a woman user, her nails may be prevented from being broken when the user presses the actuator.

Also, according to the present invention, since a direction for pressing the actuator is the same as a direction for pulling a door, the door may be opened more conveniently and smoothly.

Also, according to the present invention, a rotational shaft may be prevented from being changed during rotation of the door, whereby the door may be rotated stably.

BRIEF DESCRIPTION OF DRAWINGS

FIG. 1 is a perspective diagram illustrating a laundry treating apparatus according to the present invention;

FIG. 2 is a perspective diagram illustrating a state of a door rotated along a first rotational direction in FIG. 1;

FIG. 3 is a perspective diagram illustrating a state of a door rotated along a second rotational direction in FIG. 1;

FIG. 4 is a diagram illustrating a state of a second hinge rotated along a first rotational direction;

FIG. 5 is a diagram illustrating a state of a second hinge rotated along a second rotational direction;

FIG. 6 is a diagram illustrating the inside of an outer frame according to one embodiment of the present invention;

FIG. 7 is a diagram illustrating a structure of an actuator according to the first embodiment of the present invention (embodiment 1 of priority 1);

FIG. 8 is a diagram illustrating a structure of an actuator according to the second embodiment of the present invention (embodiment 2 of priority 1);

FIG. 9 is a diagram illustrating the inside of an outer frame according to another embodiment of the present invention, which is different from that of FIG. 6;

FIG. 10 is a diagram illustrating a structure of an actuator according to the third embodiment of the present invention (embodiment of priority 2—gear);

(a) and (b) of FIG. 11 are diagrams illustrating operation methods of an actuator shown in FIG. 10;

FIG. 12 is a diagram illustrating a structure of an actuator according to the fourth embodiment of the present invention (embodiment of priority 3 two actuators);

(a) and (b) of FIG. 13 are diagrams illustrating operation methods of an actuator shown in FIG. 12;

FIG. 14 is a diagram illustrating a relation between a motion of a first switching member and a first hinge in accordance with an operation of an actuator;

FIGS. 15 and 16 are diagrams illustrating a relation between a motion of a second switching member and a third hinge in accordance with an operation of an actuator;

FIG. 17 is a diagram illustrating a relation between a second switching member and a third hinge in a state that a door is rotated in a second rotational direction;

(a) of FIG. 18 is a conceptual diagram illustrating an operation method of a conventional actuator, and (b) of FIG. 18 is a conceptual diagram illustrating a normal operation method of an actuator according to the first to fourth embodiments of the present invention;

FIGS. 19 and 20 are diagrams illustrating a lock provided in a first switching member; and FIGS. 21 and 22 are diagrams illustrating another example of a lock.

MODE FOR THE INVENTION

Hereinafter, the preferred embodiments of the present invention that may achieve the above objects in detail will be described with reference to the accompanying drawings.

FIG. 1 is a perspective diagram illustrating a laundry treating apparatus according to the present invention, FIG. 2 illustrates that a door of FIG. 1 is rotated along a first rotational direction (that is, horizontal direction or left and right direction), and FIG. 3 illustrates that a door of FIG. 1 is rotated along a second rotational direction (that is, vertical direction or up and down direction). Hereinafter, the laundry treating apparatus according to the present invention will be described with reference to FIGS. 1 to 3.

The laundry treating apparatus according to the present invention includes a cabinet 3 having a laundry accommodating room (R) and a laundry opening 37 enabling laundry to be loaded into the laundry accommodating room, a door 4 provided to open and close the opening 37, and hinge units 5, 6, and 7 configured to rotate the door 4 to open and close the opening, along different directions.

The cabinet 3 may define a profile of the laundry treating apparatus, and the laundry opening 37 may be provided to pass through a front panel 33 provided on a side of the cabinet to communicate with the laundry accommodating room (R). A drum may rotatably be installed in the cabinet 3. Accordingly, the laundry loaded into the drum through the opening 37 may be washed or dried by rotation of the drum.

A locking projection receiving part 39 may be provided in the front panel 33 to receive a locking projection 47 provided in the door 4. The locking projection 47 of the door 4 may be received in the locking projection receiving part 39 provided at the cabinet, such that the door 4 may close the laundry opening.

In the meanwhile, a control panel 31 may be provided on the cabinet 3 to enable a user to input a control command to the laundry treating apparatus.

The hinge units 5, 6 and 7 may form a first pivot (or a first rotating axis) (A) for rotating the door 4 to open and close the opening 37 and a second pivot (or a second rotating axis)(B) for rotating the door 4 to open and close the opening 37 along a different direction from a direction of the first pivot (A). Preferably, the first pivot (A) is vertical to the bottom 32 of the cabinet 3, and the second pivot (B) is horizontal to the bottom 32 of the cabinet 3.

The first pivot A is formed by the first hinge 5 and the second hinge 6, and the second pivot B is formed by the second hinge 6 and the third hinge 7.

In FIGS. 2 and 3, the first pivot (A) may be formed along a vertical direction of the cabinet 3 (that is, height direction or longitudinal direction of the door), and the second pivot (B) may be formed along a horizontal direction of the cabinet 3 (width direction or horizontal direction of the door). However, the position of the first pivot and the position of the second pivot may not be limited to what shown in FIG. 2 necessarily. In other words, the first pivot (A) and the second pivot (B) may be located at various positions of the cabinet as far as the door 4 is rotated along different directions to open the opening (as far as the first pivot and the second pivot form a preset angle).

The first hinge 5 includes a first shaft 51 forming the first pivot (A) and a first shaft detachable part 53 having a first receiving groove 531 (see FIG. 14) formed therein to receive the first shaft 51. The first shaft 51 may be installed at the cabinet 3, and the first shaft detachable part 53 may be provided at the door 4.

Also, the third hinge 7 includes a fourth shaft 713 forming the second pivot (B) and a fourth shaft detachable part 73 having a second receiving groove 731 (see FIG. 15) formed therein to receive the fourth shaft 713. The fourth shaft 713 may be installed at the door 4, and the fourth shaft detachable part 73 may be provided at the cabinet 3. The second hinge 6 that may form both the first pivot (A) and the second pivot (B) will be described later.

As shown in FIG. 2, when the door 4 is rotated along a first rotational direction, the first hinge 5 and the second hinge 6 may couple the door 4 to the cabinet 3 such that the door 4 may be rotated with respect to the cabinet 3 along the first rotational direction. At this time, in the third hinge 7, the door 4 may be detached from the cabinet 3.

In contrast, as shown in FIG. 3, when the door 4 is rotated along a second rotational direction, the second hinge 6 and the third hinge 7 may couple the door 4 to the cabinet 3 such that the door 4 may be rotated with respect to the cabinet 3 along a second rotational direction. At this time, in the first hinge 5, the door 4 may be detached from the cabinet 3.

In other words, the door 4 is always rotatably coupled to the cabinet 3 in the hinge 6 regardless of the rotational direction of the door 4 selected by the user.

The door 4 may include an inner frame 43 provided toward the front panel 33 (that is, arranged toward the opening 37) and an outer frame 41 coupled to the inner frame 43 to form a profile and arranged toward the outside of the cabinet 3. Also, the door 4 may further include a transparent part 45, and the user may see the laundry accommodating room (R) through the transparent part 45.

As shown in FIG. 3, a recessed part 992 recessed as much as a predetermined depth along a horizontal extension direction (that is, width direction or horizontal direction) of the door 4 may be provided at an upper end of the door 4. The recessed part 992 may be longitudinally extended along a horizontal extension direction of the door 4. The recessed part 992 may be extended as long as the horizontal length of the door 4.

An actuator (or a pressing piece) 990 that is able to be grasped by the user may be provided in the recessed part 992. The actuator 990 may be installed in the recessed part 992 at the center of the upper end of the door 4, and the user may press the actuator 990 when rotating the door 4 along the second rotational direction.

In the meanwhile, in order to rotate the door 4 along the first rotational direction, the user may grasp a side grip or side recessed part 980 formed at a side of the door 4 located at an opposite side of the first pivot (A) to rotate the door 4 around the first pivot (A).

Also, the user may grasp not the actuator 990 but other portions of the recessed part 992 where the actuator 990 is not located, to rotate the door 4 around the first pivot (A). For example, the user may grasp a portion located in the recessed part 992 to be far away from the first pivot (A).

FIG. 4 is a diagram illustrating the second hinge 6 which is rotated along a first rotational direction, and FIG. 5 is a diagram illustrating the second hinge 6 which is rotated along a second rotational direction. Hereinafter, the operation of the second hinge 6 according to the rotational direction of the door 4 will be described with reference to FIGS. 4 and 5.

The second hinge 6 may couple the cabinet 3 to the door 4, to secure the door 4 in a state of being selectively rotatable along the first and second rotational directions. The second hinge 6 may be configured to allow the door 4 to be rotatably coupled to the cabinet 3 when the door 4 is rotated on both of the first pivot (A) and the second pivot (B).

The second hinge 6 includes a cabinet securing part 61 secured to the cabinet 3 and a door securing part 65 secured to the door 4.

A second shaft 651 constituting the first pivot (A) may be provided in the door securing part 65. The door 4 may be rotated on the second shaft 651 along the first rotational direction. That is, the door 4 may be rotated on the second shaft 651 with respect to the door securing part 65.

The door securing part 65 and the cabinet securing part 61 may be coupled to each other to be rotatable on a third shaft 63 constituting the second pivot (B). The door 4 may be rotated on the third shaft 63 along the second rotational direction.

As shown in FIG. 4, the door is fixed with regard to the third shaft 63 when the door 4 is rotated along the first rotational direction.

In the meanwhile, as shown in FIG. 5, the door 4 is fixed with regard to the second shaft 651 when the door is rotated along the second rotational direction.

A recess 42 recessed to a predetermined depth may be formed at a lower end of the door 4. The recess 42 may provide a predetermined space where the cabinet securing part 61 may be received. As shown in FIG. 4, the recess 42 may form a sufficient space not to generate interference between the cabinet securing part 61 and the lower end of the door 4 when the door 4 is rotated along the second rotational direction.

As described above, when the door 4 is rotated along the first rotational direction, the door 4 may be rotated based on the first shaft 51 and the second shaft 651, which constitute the first pivot (A). Also, when the door 4 is rotated along the second rotational direction, the door 4 may be rotated based on the third shaft 63 and the fourth shaft 713, which constitute the second pivot (B).

FIG. 6 is a diagram illustrating the inside of an outer frame according to one embodiment of the present invention. That is, FIG. 6 illustrates the inside of the outer frame 41 of the door in FIG. 1. In more detail, in FIG. 6, the inner frame 43 is omitted from the door 4 to disclose various elements installed in the outer frame 41. Particularly, a structure of the actuator 990 according to the embodiment of the present invention, which will be described in more detail with reference to FIG. 7, is applied to FIG. 6. Hereinafter, a structure of the door 4 which may be rotated around any one of the first pivot (A) and the second pivot (B) will be described with reference to FIG. 6.

In FIG. 6, a line extended along a vertical direction at the left side of the door 4 represents the first pivot (A) and a line extended along a horizontal direction at a lower portion of the door 4 represents the second pivot (B). In other words, in FIG. 6, the first hinge 5 may be provided at a left upper portion of the door 4, the second hinge 6 may be provided at a left lower portion of the door 4, and the third hinge 7 may be provided at a right lower portion of the door 4. Meanwhile, since FIG. 6 only illustrates elements installed in the door 4, among the first hinge 5, the second hinge 6 and the third hinge 7, anyone installed in the cabinet 3 may not be shown.

Pivot switching members 1000 and 1100 may be provided in the door 4 to secure the door 4 to the first pivot (A) or the second pivot (B), when the door 4 is rotated on the first pivot (A) or the second pivot (B).

The pivot switching members 1000 and 1100 may include a first switching member 1000 and a second switching member 1100, which may be moved by the operation of the actuator 990. In this case, the first switching member 1000 and the second switching member 1100 may be referred to as a first bar and a second bar, respectively.

When the user moves the actuator 990 after grasping it by the hand, as shown in an arrow of FIG. 6, the first switching member 1000 may be moved to a lateral direction of the door 4 and the second switching member 1100 may be moved to a downward direction of the door 4 (also shown by an arrow).

In more detail, in FIG. 6, since an inclined surface 1003 is formed in the first switching member 1000, if the actuator 990 is pressed, the first switching member 1000 is moved to a rightward direction, and the second switching member 1100 is moved toward a lower side of the door 4, wherein the lower side of the door 4 is parallel to the moved direction of the first switching member 1000.

The first switching member 1000 may have a limited moving path to move only along the horizontal direction (that is, left and right direction or width direction of the door). Also, the second switching member 1100 may have a limited moving path to move only along the vertical direction (that is, up and down direction or height direction of the door).

An inclined surface 1101 is formed at an upper end of the second switching member 1100, whereby the second switching member 1100 may be moved downwardly (that is, vertical direction) with respect to the horizontal moving distance of the first switching member 1000.

The inclined surface 1101 may have a tapered shape that is getting narrower upwardly and wider downwardly. Accordingly, when the first switching member 1000 is moved to the right, the second switching member 1100 may be moved downwardly. In other words, the horizontal motion of the first switching member 1000 may change the motion of the second switching member 1100 to the vertical motion.

As described above, the first switching member 1000 may be moved horizontally and the second switching member 1100 may be moved vertically, in accordance with the actuation (that is, pressurization) of the actuator 990.

In more detail, the first switching member 1000 may secure the door 4 and the cabinet 3 to each other to maintain the coupled state on the first pivot (A) when the door 4 is rotated along the first rotational direction. Especially, the first switching member 1000 may secure the door 4 to be rotatably coupled to the cabinet 3 in the first hinge 5 when the door 4 is rotated along the first rotational direction.

The first switching member 1000 may be arranged at the end of the actuator 990 and may be moved as the actuator 990 is moved.

Meanwhile, a first elastic member 1030 may be provided at one side of the first switching member 1000 to restitute the first switching member 1000 to an original position, when the force applied to the first switching member 1000 is removed.

At this time, the first elastic member 1030 may preferably be a tension spring. In other words, the first elastic member 1030 may be tensioned, because the first switching member 1000 is moved toward a rightward direction in the case that the force pushing the first switching member 1000 to the right side is applied to the first elastic member 1030.

In contrast, in the case the force applied to the first switching member 1000 is removed, the first elastic member 1030 may pull the first switching member 1000 to the left side to be restituted to the original position.

Also, a second elastic member 1130 may be provided at one side of the second switching member 1100 to restitute the second switching member 1100 to an original position, when the force applied to the second switching member 1100 is removed.

In other words, the first switching member 1000 is moved to the right side and the second switching member 1100 is moved downwardly, in accordance with the motion of the actuator 990. At this time, if the force applied to the first switching member 1000 is removed, the force applied to the second switching member 1100 is also removed, whereby the second elastic member 1130 pulls the second switching member 1100 upwardly to restitute the second switching member 1100 to the original position.

Preferably, the second elastic member 1130 may also be a tension spring. Also, the second elastic member 1130 may only be provided without the first elastic member 1030. That is, even though the first elastic member 1030 is not provided, if the second switching member 1100 is pulled upwardly by the second elastic member 1130, the first switching member 1000 may be restituted to the original position by being pushed to the left side by the inclined surface 1101 formed at the upper end of the second switching member 1100.

In the meanwhile, the door 4 may further include a lock 70 for restricting the horizontal motion of the first switching member 1000. The lock 70 will be described in detail with reference to the following drawings.

FIG. 7 is a diagram illustrating a structure of an actuator 990 according to the first embodiment of the present invention. Motion of the first switching member 1000 according to actuation of the actuator 990 will be described in detail with reference to FIGS. 6 and 7.

First of all, the actuator 990 includes a pivot shaft 995 for pivoting the actuator 990, a first portion 996 extended from above the pivot shaft 995 beyond the povot shaft 995 toward the bottom 993 of the recessed part 992, and a second portion 997 extended from the end portion of the first portion 996 toward a space below the bottom 993 of the recessed part 992. At this time, the first portion 996 and the second portion 997 may be formed in a single body.

Also, the first portion 996 of the actuator 990 is provided with a pressing point 998 pressed by the user, wherein the pressing point 998 is arranged to be higher than the pivot shaft 995. In this case, the terminology "ressing point represents a portion of the actuator 990 (that is, the first portion 996 of the actuator 990), which is pressed by the user.

For example, the pressing point 998 may be provided at the upper end of the actuator 990. In other words, the pressing point 998 may be provided at the upper end of the first portion 996 of the actuator 990.

The second portion 997 of the actuator 990 may be formed by being bent several times. Also, a pressing portion 991 projected toward the inner frame 43 may be formed at one end (that is, free end of the second portion 997) of the second portion 997 of the actuator 990.

In more detail, the pressing portion 991 projected toward the inner frame 43 may be formed at the free end of the second portion 997 of the actuator 990. The pressing portion 991 is formed in such a manner that the second portion 997 is bent several times and thus projected toward the inner frame 43.

In this case, the inner frame 43 is coupled to the outer frame 41 by interposing the actuator 990 therebetween. That is, the actuator 990 is arranged between the inner frame 43 and the outer frame 41.

Also, the inclined surface 1003 for moving the pivot switching members 1000 and 1100 in accordance with pressurization of the actuator 990 may be formed in at least one of the pivot switching members 1000 and 1100. In more detail, a bent portion 1002 bent to surround at least a part of the pressing portion 991 may be formed in the pivot switching members 1000 and 1100, and the inclined surface 1003 may be formed at one side of the bent portion 1002.

For example, the bent portion 1002 may be formed in the first switching member 1000. The bent portion 1002 is formed as the first switching member 1000 is bent. In more detail, the bent portion 1002 may be formed to surround at least a part of the pressing portion 991 in a horizontal direction (that is, lateral direction of the door 4).

The inclined surface 1003 of the bent portion 1002 may be inclined toward the pressing portion 991. For example, the inclined surface 1003 may be inclined toward the first hinge 5 of the door 4 (that is, toward the left side in FIG. 6). Also, the inclined surface 1003 of the bent portion 1002 may be arranged to be partially in contact with the pressing portion 991.

Accordingly, if the user grasps the actuator 990 and presses the first portion 996 (that is, the pressing point 998 of the first portion 996) of the actuator 990, the actuator 990 is rotated counterclockwise on the pivot shaft 995 (if viewed from the location of the first hinge 5).

In other words, if the pressing point 998 of the actuator 990 is pressed by the user, the first portion 996 of the actuator 990 is moved to the pressed direction, and the second portion 997 of the actuator 990 is moved to an opposite direction of the pressed direction of the first portion 996.

In more detail, if the pressing point 998 of the actuator 990 is pressed by the user, the first portion 996 is moved toward the outer frame 41, and the second portion 997 is moved toward the inner frame 43 (see arrow of FIG. 7). At this time, the pressing portion 991 of the second portion 997 pushes the inclined surface 1003 of the first switching member 1000, whereby the first switching member 1000 is moved along the horizontal direction of the door 4 (that is, width direction or lateral direction of the door 4).

For example, referring to FIG. 6, if the pressing portion 991 pushes the inclined surface 1003 of the first switching member 1000 toward the inner frame 43, the first switching member 1000 may be moved to the rightward direction.

FIG. 8 is a diagram illustrating a structure of an actuator 990 according to the second embodiment of the present invention. Motion of the first switching member 1000 according to pressurization of the actuator 990 will be described in detail with reference to FIGS. 6 and 8. Also, to assist understanding, the same reference numbers will be used throughout the drawings to refer to the same or like parts described in the embodiment of FIG. 7.

As described in the embodiment of FIG. 7, the actuator 990 according to this embodiment also includes a pivot shaft 995 for pivoting the actuator 990, a first portion 996 extended from the pivot shaft 995 toward the bottom 993 of the recessed part 992, and a second portion 997 extended from the end portion of the first portion 996 toward a space below the bottom 993 of the recessed part 992. At this time, the first portion 996 and the second portion 997 may be formed in a single body.

Also, the first portion 996 of the actuator 990 may be provided with a pressing point 998 pressed by the user.

For example, the pressing point 998 may be provided at the upper end of the actuator 990. In other words, the pressing point 998 may be provided at the upper end of the first portion 996 of the actuator 990.

The actuator 990 may be provided with a pressing portion 991 downwardly extended toward the inner side of the door 4. For example, the pressing portion 991 may be formed to be extended vertical-downwardly toward the inner side of the door 4.

In more detail, the pressing portion 991 projected vertical-downwardly toward the second pivot (B) may be provided in the second portion 997 of the actuator 990. Preferably, the pressing portion 991 has a cylindrical shape.

However, the pressing portion 991 may have various shapes in addition to the cylindrical shape if the pressing portion 991 is projected vertical-downwardly from the second portion 997 of the actuator 990.

Also, an inclined surface 1005 for moving the switching members 1000 and 1100 in accordance with pressurization of the actuator 990 may be formed in at least one of the switching members 1000 and 1100. In more detail, a projection 1004 projected toward the inner frame 43 may be formed at the middle of the first switching member 1000 which is a fixed member, and the inclined surface 1005 may be formed at one side of the projection 1004.

Preferably, the pressing portion 991 and the inclined surface 1005 are arranged in contact with each other. In more detail, the side of the cylindrical shaped pressing portion 991 may be in contact with the inclined surface 1005. In this case, the inner frame 43 is coupled to the outer frame 41 by interposing the actuator 990 therebetween. That is, the actuator 990 is arranged between the inner frame 43 and the outer frame 41.

Also, the inclined surface 1005 of the projection 1004 may be inclined toward the pressing portion 991. For example, the inclined surface 1005 may be inclined toward the first hinge 5 of the door 4 (that is, toward the left side in FIG. 6).

In other words, the projection 1004 projected toward the inner frame 43 in the first switching member 1000 may be formed to have a width becoming greater toward the inner frame 43. Accordingly, the inclined surface 1005 may be formed at the side of the projection 1004 facing the pressing portion 991. At this time, the inclined surface 1005 of the projection 1004 may be arranged to be partially in contact with the pressing portion 991.

Accordingly, if the user grasps the actuator 990 and presses the first portion 996 (that is, the pressing point 998 of the first portion 996) of the actuator 990, the actuator 990 is rotated counterclockwise on the pivot shaft 995 (if viewed from the location of the first hinge 5).

In other words, if the first portion 996 of the actuator 990 is pressed, the second portion 997 is moved to an opposite direction of the pressed direction of the first portion 996. In other words, if the pressing point 998 of the actuator 990 is pressed by the user, the first portion 996 of the actuator 990 is moved to the pressed direction, and the pressing portion 991 provided in the second portion 997 of the actuator 990 is moved to the opposite direction of the pressed direction of the first portion 996.

In more detail, if the pressing point 998 of the actuator 990 is pressed by the user, the first portion 996 is moved toward the outer frame 41, and the pressing portion 991 provided in the second portion 997 is moved toward the inner frame 43 (see arrow of FIG. 8). At this time, the pressing portion 991 of the second portion 997 pushes the projection 1004 of the first switching member 1000, whereby the first switching member 1000 is moved along the horizontal direction of the door 4 (that is, width direction or lateral direction of the door 4).

For example, if the pressing portion 991 pushes the inclined surface 1005 of the projection 1004 provided in the first switching member 1000 toward the inner frame 43, the first switching member 1000 may be moved to the right (shown as an arrow in FIG. 6).

Also, a plurality of ribs 999 spaced apart from one another at a predetermined distance and extended in a vertical direction may be formed in the first portion 996 of the actuator 990, so that the user may easily grasp the actuator 990. The user may press the actuator 990 by grasping the plurality of ribs 999.

Also, these ribs 999 may equally be applied to the embodiment of the actuator 990 described with reference to FIG. 7.

In the meanwhile, in the outer frame 41 and the actuator 990 shown in FIGS. 7 and 8, the outer frame 41 may be bent (or rotated) toward the pressed direction of the actuator 990.

In more detail, when the pressing point 998 of the actuator 990 is pressed by the user, a bent portion 401 of the outer frame 41 arranged in the pressed direction of the first portion 996 of the actuator 990 may be bent toward the pressed direction of the first portion 996.

Accordingly, a pivot angle of the actuator 990 may be increased as much as the bent portion 401 of the outer frame 41, which is bent. The bent portion 401 of the outer frame 41 may be formed in only a portion corresponding to the first portion 996 of the actuator 990, or may be formed in a longitudinal direction at the upper side of the outer frame 41.

Also, in the embodiment shown in FIG. 7, the second portion 997 of the actuator 990 is arranged between the first switching member 1000 and the outer frame 41. Unlike the embodiment of FIG. 7, the first switching member 1000 is arranged between the outer frame 41 and the second portion 997 of the actuator in the embodiment shown in FIG. 8.

FIG. 9 is a diagram illustrating the inside of an outer frame according to another embodiment of the present invention, which is different from that of FIG. 6.

The inside of the outer frame shown in FIG. 9 is similar to the structure shown in FIG. 6.

In other words, the first switching member 1000 is moved along a horizontal direction and the second switching member 1100 is moved along a vertical direction, in accordance with the operation (that is, pressurization) of the actuator 990. Hereinafter, a structure of the outer frame shown in FIG. 9 will be described based on the structure different from that shown in FIG. 6.

A projection piece 1002' projected to be inclined as much as a predetermined height is formed in the first switching member 1000 of the pivot switching member, and a pressing portion 991 projected toward the projection piece 1002' is formed at a free end of the second portion 997 of the actuator 990.

The projection piece 1002' may be projected to be inclined at the center of the first switching member 1000, and the pressing portion 991 may be projected to face the projection piece 1002' That is, the projection piece 1002' may be projected toward its inclined surface.

If the user presses the actuator 990 by grasping the actuator 990, the pressing portion 991 pushes the inclined surface of the projection piece 1002' of the first switching member 1000. At this time, the first switching member 1000 is moved along the horizontal direction (that is, width direction or lateral direction of the door) of the door 4.

For example, referring to FIG. 9, the projection piece 1002' of the first switching member 1000 may be formed to be inclined such that the first switching member 1000 is moved to the right side when the projection piece 1002' is pressed by the pressing portion 991. That is, as viewed in FIG. 9, the projection piece 1002' may be inclined toward the right side.

In the meanwhile, even in this embodiment, the door 4 may further include a lock 70 for restricting the horizontal motion of the first switching member 1000.

FIG. 10 is a diagram illustrating a structure of an actuator 990 according to the third embodiment of the present invention, and (a) and (b) of FIG. 11 are diagrams illustrating operation methods of the actuator shown in FIG. 10.

Hereinafter, a structure of the actuator according to the third embodiment of the present invention will be described with reference to FIG. 10 and (a) and (b) of FIG. 11.

A pivot shaft 995 of the actuator 990 according to this embodiment (FIG. 10, and (a) and (b) of FIG. 11) is located to be lower than the pressing point 998. That is, in this embodiment, the pivot shaft 995 of the actuator 990 may be provided between the first portion 996 and the second portion 997 of the actuator 990.

For example, the pivot shaft 995 may be located near the bottom 993 of the recessed part 992, and the pressing point 998 may be spaced apart upwardly from the bottom 993 of the recessed part 992 and thus may be located at the upper side of the recessed part 992. Meanwhile, the first portion 996 and the second portion 997 may be formed in a single body.

For example, the pressing point 998 may be provided at the upper end of the actuator 990. In other words, the pressing point 998 may be provided at the upper end of the first portion 996 of the actuator 990.

In more detail, the actuator 990 may include the first portion 996 arranged within the recessed part 992 and the second portion 997 bent from the end of the first portion 996 and extended a space below the bottom 993 of the recessed part 992. The pivot shaft 995 for pivoting the actuator 990 is provided on the bottom 993 of the recessed part 992.

Accordingly, when the upper side of the actuator 990 or the pressing point 998 of the actuator 990 is pressed, the free end of the second portion 997 may be moved to an opposite direction of the pressed direction of the pressing point 998 of the actuator 990.

For example, if the first portion 996 of the actuator 990 is pushed along a left arrow (that is, toward the outer frame of the door 4), the second portion 997 of the actuator 990 may be moved toward a right arrow (that is, toward the inner frame 43 of the door 4).

In this case, the inner frame 43 is coupled to the outer frame 41 by interposing the actuator 990 therebetween. That is, the actuator 990 is arranged between the inner frame 43 and the outer frame 41. Also, the first switching member 1000 may be arranged between the outer frame 41 and the second portion 997 of the actuator 990.

Second gear teeth 971 for transferring a dynamic force based on pressurization of the first portion 996 of the actuator 990 to the first switching member 1000 may be formed at the side of the second portion 997 of the actuator 990, so that the dynamic force may be transferred to the pivot switching members 1000 and 1100.

In other words, the second gear teeth 971 for transferring the force for pressing the actuator 990 to the first switching member 1000 may be formed at the side of the second portion 997 of the actuator 990.

In more detail, the second portion 997 of the actuator 990 may include a first extension portion 950 obliquely extended from the space below the bottom 993 of the recessed part 992 toward the inner frame 43 of the door 4, a second extension portion 960 downwardly extended from the first extension portion 950, and a third extension portion 970 obliquely extended from the second extension portion 960 toward the outer frame 41 of the door 4.

Also, the second gear teeth 971 may be formed at one side of the third extension portion 970.

A vertical beam 2000 is rotatably coupled to the lower side of the recessed part 992. The vertical beam 2000 is extended toward the space of the bottom 993 of the recessed part 992 and rotatably coupled to a groove formed below the bottom 993 of the recessed part 992. A first gear 2100, which may be rotated by interacting with rotation of the vertical beam 2000, may be provided at the end of the vertical beam 2000, and a second gear 2200, which may be rotated by interacting with the rotation of the vertical beam 2000, may be provided at a longitudinal middle portion of the vertical beam 2000.

Also, the vertical beam 2000 and the second portion 997 of the actuator 990 may be aligned such that the second gear teeth 971 formed at one side of the third extension portion 870 may be engaged with the first gear 2100.

In other words, the second gear teeth 971 is formed at a side of the third extension portion 970 toward the first gear 2100 and thus engaged with the first gear 2100.

Accordingly, as the first portion 996 of the actuator 990 is pressed, if the second portion 997 of the actuator 990 is moved toward the inner frame 43 of the door 4, the second gear teeth 971 formed at one side of the second portion 997 rotates the first gear 2100 counterclockwise (that is, leftward direction)(if viewed from the location of the first hinge 5).

The vertical beam 200 and the second gear 2000 are rotated in the same direction (that is, counterclockwise) as that of the first gear 2100 by interacting with the rotation of the first gear 2100.

Also, first gear teeth 1050 may be formed at one side of the pivot switching member along a longitudinal direction of the pivot switching member. In more detail, the first gear teeth 1050 may be formed at one side of the first switching member 1000 along the longitudinal direction of the first switching member 1000.

The first gear teeth 1050 formed in the first switching member 1000 may receive the dynamic force from the second gear teeth 971 formed at one side of the second portion 997. For example, the first gear teeth 1050 formed in the first switching member 1000 is arranged to be engaged with the second gear 2200 of the vertical beam 2000.

That is, the first gear teeth 1050 formed in the first switching member 1000 may be engaged with the second gear in a rack pinion type.

In this case, the rotation of the first gear 2100 rotates the vertical beam 2000, and the rotation of the vertical beam 2000 rotates the second gear 2200 in the same direction as that of the first gear 2100. Also, the rotation of the second gear 2200 is transferred to the first gear teeth 1050 of the first switching member 1000, which is engaged with the second gear 2200.

Accordingly, if the second gear 2200 is rotated counterclockwise, the first switching member 1000 is moved along the horizontal direction (that is, rightward direction).

In more detail, the state (FIG. 10 and (a) of FIG. 11) that the actuator 990 is not operated and the state ((b) of FIG. 13) that the actuator 990 is operated will be described with reference to FIG. 10, (a) of FIG. 11, and (b) of FIG. 13, respectively.

In order to rotate the door 4 along the second rotational direction, the user may press the first portion 996 of the actuator 990 or the pressing point 998 provided in the first portion 996 of the actuator 990. If the first portion 996 or the pressing point 998 is pressed, the second portion 997 of the actuator 990 is moved toward the inner frame 43 (that is, toward right arrow in (b) of FIG. 11) on the pivot shaft 995.

At this time, as the second gear teeth 971 formed at one side of the third extension portion 970 of the second portion 997 is engaged with the first gear 2100 of the vertical beam 2000, the first gear 2100 is rotated counterclockwise. The rotation of the first gear 2100 is transferred to the second gear 2200 through the vertical beam 2000, whereby the second gear 2200 is rotated along the same direction as that of the first gear 2100.

Also, since the second gear 2200 is engaged with the first gear teeth 1050 formed along the longitudinal direction of the first switching member 1000, the rotation of the second gear 2200 moves the first switching member 1000 to a horizontal direction (that is, rightward direction).

In other words, if the second gear 2200 is rotated counterclockwise, the first switching member 1000 is moved toward the rightward direction.

According to this embodiment, since the force pressing the actuator is transferred to the first switching member 1000 and the second switching member 1100 by engagement of the gear, it is advantageous in that there is no risk in occurrence of sliding during transfer of the force.

If the first switching member 1000 is moved toward the rightward direction, the end portion of the first switching member 1000 pushes the inclined surface of the second switching member 1100 and the second switching member 1100 is moved downwardly (that is, lower direction) in the same manner as the aforementioned embodiment. Therefore, the detailed description will be omitted.

In the meanwhile, according to the modified embodiment which is not shown, the first gear teeth 1050 of the first switching member 1000 may be formed to be inclined along the longitudinal direction (for example, width direction of the door) of the first switching member 1000, and the second portion 997 may be bent toward the outer frame 41 such that the free end of the second portion 997 may be arranged above or below the first switching member 1000.

At this time, gear teeth inclined in the same direction as the inclined direction of the first gear teeth 1050 may be formed at the side facing the first switching member 1000 at the free end of the second portion 997 such that the gear teeth may be engaged with the first gear teeth 1050.

Accordingly, if the actuator 990 is pressed by the user, the gear teeth formed at the free end of the second portion 997 may push the first gear teeth 1050 toward the side, whereby the first switching member 1000 may be moved toward a lateral direction (that is, width direction of the door).

In other words, the force pressing the actuator 990 may directly be transferred from the gear teeth formed at the free end of the second portion 997 to the first gear teeth 1050 formed in the first switching member 1000. In case of this embodiment, the vertical beam 2000, the first gear 2100 and the second gear 2200 are not required.

FIG. 12 is a diagram illustrating a structure of an actuator according to the fourth embodiment of the present invention, and (a) and (b) of FIG. 13 are diagrams illustrating operation methods of an actuator shown in FIG. 12. The actuator according to this embodiment may be applied to the outer frame shown in FIG. 9.

FIG. 12 and (b) of FIG. 13 illustrate the state that the actuator 990 according to another embodiment of the present invention is operated, and (a) of FIG. 13 illustrates the state that the actuator 990 is not operated.

Referring to FIG. 12, (a) and (b) of FIG. 13, the first switching member 1000 is moved to the side (that is, right side) by pressurization of the actuator 990 and the second switching member 1100 is moved downwardly (that is, lower side), in the same manner as the aforementioned operation of the actuator 990 and the first switching member 1000.

The actuator 990 according to this embodiment may include a first actuator 910 that may be pressed by the user and a second actuator 920 that may be pressed by the first actuator 910.

In more detail, the first actuator 910 includes a first pivot shaft 994 for pivoting the first actuator 910 and a first pressing point 912 pressed by the user.

For example, the first pressing point 912 may be provided at an upper end of the first actuator 910.

The first actuator 910 may be arranged within the recessed part 992. Preferably, the first pressing point 912 of the first actuator 910 is arranged to be higher than the first pivot shaft 994. That is, the first pivot shaft 994 may be provided at a lower end of the first actuator 910.

Also, the second actuator 920 includes a second pivot shaft 995 for pivoting the second actuator 920 and a second pressing point 922 pressed by the first actuator 910. Preferably, the second pressing point 922 of the second actuator 920 is arranged to be lower than the second pivot shaft 995. Also, it is preferable that the first pressing point 912 of the first actuator 910 is arranged to face (that is, at a height corresponding to that of the second pivot) the second pivot 995 of the second actuator 920.

At this time, it is preferable that the first pivot shaft 994 of the first actuator 910 is arranged to be lower than the second pressing point 922 of the second actuator 920.

Also, the first actuator 910 may include a projection 911 projected from one side of the first actuator 910, wherein the second actuator 920 may be in contact with or fixed to the projection 911.

For example, the projection 911 may be projected toward the second actuator 920 and thus may be in contact with or fixed to the second pressing point 922 of the second actuator 920. Accordingly, if the first actuator 910 is pressed by the user, the second actuator 920 may be pressed by the projection 911.

In the meanwhile, the second actuator 920 may be fixed to the projection 911 of the first actuator 910 by a bolt (not shown), or may partially be inserted into a groove (not shown) formed in the projection 911, whereby the second actuator 920 may be fixed to the projection 911.

Also, the end of the projection 911 formed in the first actuator 910 may be configured to be in contact with the second pressing point 922 of the second actuator 920. Accordingly, if the first actuator 910 is pressed, the second actuator 920 may be pressed by the projection 911.

The second actuator 920 includes a first portion 996 extended from the second pivot shaft 995 to the bottom 993 of the recessed part 992 and a second portion 997 extended from the end of the first portion 996 to a space below the bottom 993 of the recessed part 992.

In other words, the second actuator 920 may include the first portion 996, the second pivot shaft 995 provided at the upper end of the first portion 996, and the second portion 997 extended from the lower end of the first portion 996, wherein the first portion 996 and the second portion 997 may be formed in a single body.

The second pressing point 992 may be provided at a middle portion along a height direction of the first portion 996 of the second actuator 920, and may be pressed by the projection 911 formed in the first actuator 910. For example, the second pressing point 992 may be provided at a height between the first pivot shaft 994 and the second pivot shaft 995.

The second portion 997 of the second actuator 920 may be formed to be extended from the end of the first portion 996 to the space below the bottom 993 of the recessed part 992. Also, the free end of the second actuator 920 may be bent toward the outer frame 41 of the door 4.

For example, the pressing portion 991 bent toward the outer frame 41 of the door 4 may be formed at the free end of the second actuator 920. The pressing portion 991 is projected toward the projection piece 1002' formed in the first switching member 1000. That is, the pressing portion 991 may be projected to face the projection piece 1002'.

Accordingly, if the upper portion of the first actuator 910 is pressed by the user, the first portion 996 of the second actuator 920 is pressed by the projection 911 of the first actuator 910.

Then, the pressing portion 991 formed at the free end of the second portion 997 of the second actuator 920 pushes the projection piece 1002' of the first switching member 1000, whereby the first switching member 1000 is moved toward the horizontal direction (that is, width direction or lateral direction of the door) of the door 4.

As a result, the user may rotate the door 4 along the second rotational direction based on the second pivot (B).

In other words, as shown in FIG. 9, the projection piece 1002' of the first switching member 1000 may be formed to be inclined such that the first switching member 1000 may be moved toward the rightward direction when the projection piece 1002' is pressed by the pressing portion 991. That is, as viewed in FIG. 9, the projection piece 1002' may be formed to be inclined toward the right side.

In more detail, to rotate the door 4 along the second rotational direction, the user may press the first pressing point 912 of the first actuator 910. For example, as viewed in (a) of FIG. 13, the user may press the first pressing point 912 toward a left arrow (that is, toward the second pivot shaft 995 of the second actuator 920). At this time, the first pivot shaft 994 of the first actuator 910 may be rotated counterclockwise (if viewed from the location of the first hinge 5).

Also, if the first pressing point 912 is pressed by the user, the second pressing point 922 provided at the first portion 916 of the second actuator 920 fixed to the projection 911 of the first actuator 910 is pressed in the same direction (that is, toward the outer frame 41 of the door 4) as the pressed direction of the first pressing point 912. At this time, the second pivot shaft 995 may be rotated clockwise.

The above motion of the first portion 916 of the second actuator 920 is transferred to the second portion 917 of the second actuator 920, whereby the second portion 917 may also be moved to the same direction as the pressed direction of the first pressing point 912.

Accordingly, the pressing portion 991 provided at the second portion 917 of the second actuator 920 pushes the projection piece 1002' of the first switching member 1000, and the inclined surface is formed at the projection piece 1002' whereby the first switching member 1000 is moved toward the horizontal direction (that is, width direction or lateral direction of the door) of the door 4. And, the user may open the door 4 by pulling the door 4 in the pressed direction (that is, toward the body of the user) of the first actuator 910 and rotating the door 4 along the second rotational direction.

As described above, the first pivot shaft 996 of the first actuator 910 is arranged to be lower than the first pressing point 912 of the first actuator 910. That is, the first pressing point 912 pressed by the user is arranged to be higher than the first pivot shaft 996.

For example, the first pressing point 912 may be arranged between the first pivot shaft 996 and the upper side of the recessed part 992. Accordingly, when the user presses the first pressing point 912 of the first actuator 910 to rotate the door 4 along the second rotational direction, the user may press the first pressing point 912 by using his/her middle knuckle (for example, second knuckle or first and second knuckles).

In other words, the first pressing point 912 may be pressed by an entire area of the middle knuckle.

For example, if the pivot shaft 995 is arranged to be higher than the pressing point, the user should press the pressing point with his/her end knuckle by bending his/her finger to rotate the door 4 along the second rotational direction. At this time, in case of a woman user, there may be a risk that the user's nails may be broken. However, according to this embodiment, since the first pressing point 912 is pressed by the entire area of the middle knuckle, there is no risk that the user's nails may be broken even in case of the woman user.

Also, according to this embodiment, since the user does not need to bend his/her finger to press the first pressing point 912 of the first actuator 910, there is no inconvenience that the knuckle is in contact with one side of the recessed part 992.

In other words, when the first pressing point 912 of the first actuator 910 is pressed, the knuckle of the user is not bent, whereby the knuckle is not in contact with one side of the recessed part 992.

Also, the pressed direction of the first pressing point 912 pressed by the entire area of the knuckle is the horizontal direction toward the body of the user, and the direction for pulling the door 4 to rotate the door 4 along the second rotational direction is also the horizontal direction toward the body of the user.

Accordingly, the user only has to apply the force to the first pressing point 912 and the door 4 in one direction (that is, horizontal direction toward the body of the user) to rotate the door 4 along the second rotational direction, whereby the door 4 may be rotated along the second rotational direction in accordance with a more convenient and smooth operation.

FIG. 14 is a diagram illustrating a relation between a motion of a first switching member and a first hinge in accordance with an operation of an actuator, FIGS. 15 and 16 are diagrams illustrating a relation between a motion of a second switching member and a third hinge in accordance with an operation of an actuator, and FIG. 17 is a diagram illustrating a relation between a second switching member and a third hinge in a state that a door is rotated along a second rotational direction.

Hereinafter, rotational directions of the first switching member 1000, the second switching member 1100 and the door 4 according to pressurization of the actuator 990 will be described in detail with reference to FIGS. 14 to 17.

If the pressing point 998 of the actuator 990 is pressed by the user and the first switching member 1000 is moved toward a lateral direction (rightward direction), a first receiving groove 531 in which a first shaft 51 is received is opened. Accordingly, the first shaft 51 may be detached from the first receiving groove 531 (see FIG. 14).

In the meanwhile, as shown in FIG. 14, if the first switching member 1000 closes the first receiving groove 531, the first shaft 51 cannot be taken out of the first receiving groove 531, whereby the door 4 is rotatably coupled to the cabinet 3 on the first shaft 51.

However, if the first switching member 1000 is moved toward the right side by the aforementioned operation, the first shaft 51 received in the first receiving groove 531 is taken out of the first receiving groove 531, whereby the door 4 is not coupled to the cabinet 3 through the first hinge 5 which corresponds to the first shaft 51.

In other words, if the user desires to rotate the door 4 along the first rotational direction, the door 4 should be rotated on the first shaft 51 which is a part of the first pivot. Accordingly, the door 4 and the first shaft 51 should be maintained in a fixed state.

Therefore, in this case, the user may rotate the door 4 around the first pivot (A) by grasping a side grip 980 formed at the side of the door 4, or may rotate the door 4 around the first pivot (A) by grasping the other portion (for example, portion of the recessed part 992 far away from the first pivot (A)) of the recessed part 992 where the actuator 990 is not located.

At this time, since the actuator 990 is not pressed, the first switching member 1000 maintains the stopped state, and also maintains the state for closing the first receiving groove 531. Accordingly, the first shaft 51 may form the first pivot without being detached from the first receiving groove 531, whereby the door 4 may be rotated along the first rotational direction.

FIGS. 15 to 17 illustrate a coupling structure of the third hinge 7. The third hinge 7 includes a fourth shaft 713 forming the second pivot and a fourth shaft detachable part 73 having a second receiving groove formed therein to detachably receive the fourth shaft 713. The fourth shaft 713 may be provided in the door 4 and the fourth shaft detachable part 73 may be provided in the cabinet 3. The fourth shaft 713 may detachably be provided in the fourth shaft detachable part 73.

Since the door 4 closes the opening 37 in FIG. 15, the fourth shaft 713 is completely inserted in the second receiving groove 731. At this time, if the user rotates the door 4 along the first rotational direction, the fourth shaft 713 may be taken out of the second receiving groove 731 along a horizontal direction (arrow direction shown in FIG. 15).

In other words, since the second switching member 1100 does not close a horizontal entrance of the second receiving groove 731, the fourth shaft 713 may be moved horizontally from the second receiving groove 731 without interference from the second switching member 1100.

A sectional area of the fourth shaft 713 may have a first flat surface 714 of which one side is flat. At this time, an upper surface of the fourth shaft 713 may have the first plate surface 714 formed in a 'D' shape.

In the meanwhile, the fourth shaft detachable part 73 is provided with a stopper 74 for preventing the fourth shaft 713 from being rotated at a predetermined angle or more. The stopper 74 may include a second flat surface 741 corresponding to the first flat surface 714. Accordingly, if the fourth shaft 713 is rotated at a predetermined angle, the first flat surface 714 may be in surface-contact with the second flat surface 741, whereby the rotation of the fourth shaft 713 may be stopped.

FIG. 16 illustrates the state that the second switching member 1100 of FIG. 15 is moved downwardly. If user desires to rotate the door 4 along the second rotational direction, the user may press the actuator 990.

Once the actuator 990 is pressed, the first switching member 1000 is moved toward the right side, and the second switching member 1100 is moved downwardly. That is, the second switching member 1100 is moved to a lower position as shown in FIG. 16 from a position shown in FIG. 15.

As a result, the second switching member 1100 may close the second receiving groove 731, and may prevent the fourth shaft 713 from being detached from the second receiving groove 731 horizontally.

At this time, a guide groove 732 may be formed at a portion corresponding to the free end of the second switching member 1100 in the cabinet 3 to guide rotation of the free end of the second switching member 1100. For example, the fourth shaft detachable part 73 provided in the cabinet 3 may include the guide groove 732.

When the fourth shaft 713 is detached horizontally, it means that the door 4 is rotated along the first rotational direction mentioned above. Accordingly, if the second switching member 1100 closes the second receiving groove 731 of the fourth shaft detachable part 73 by pressing the actuator 990, the door 4 may be prevented from being rotated along the first direction simultaneously while it is rotated along the second rotational direction. That is, the door 4 may be prevented from being detached from the cabinet simultaneously in the first hinge 5 and the third hinge 7.

In the meanwhile, if the actuator 990 is operated (that is, pressed), the first switching member 1000 may also be moved toward the right side, and the first shaft 51 may be detached from the first receiving groove 531, whereby the door 4 may be separated from the cabinet 3 in the first hinge 5. As a result, the door 4 may be rotated along the second rotational direction.

Alternatively, if the user desires to rotate the door 4 along the first rotational direction, the actuator 990 may not be pressed by the user. As a result, the first switching member 1000 and the second switching member 1100 may maintain the original state, without being operated.

In other words, since the second switching member 1100 is arranged as shown in FIG. 15 without being moved downwardly, the fourth shaft 713 may be detached from the second receiving groove 731, whereby the door 4 may be rotated along the first rotational direction.

FIG. 17 illustrates the state that the door 4 is rotated along the second rotational direction. As shown in FIG. 17, if the door 4 is rotated along the second rotational direction, the fourth shaft 713 and the second switching member 1100 which are installed in the door 4 may be rotated at an identical angle along the door 4.

As the door 4 is rotated at a predetermined angle, when the first flat surface 714 of the fourth shaft 713 contacts with the second flat surface 741 of the stopper 74, the rotation of the fourth shaft 713 may be stopped. At this time, the second rotational direction rotation angle of the door 4 may be approximately 30 degrees to 40 degrees. The angle may be changeable according to the user convenience.

In the meanwhile, the laundry treating apparatus having the aforementioned structure only has a problem in that the first shaft 51 may be detached from the first receiving groove 531 of the first shaft detachable part 53 as the user presses the actuator 990 when the door 4 is rotated on the first pivot (A).

Also, the laundry treating apparatus having the aforementioned structure only has a problem in that the fourth shaft 713 may be prevented from being detached from the second receiving groove 731 of the fourth shaft detachable part 73 only if the pressing point 998 of the actuator 990 should be maintained in a pressed state when the door 4 is rotated on the second pivot (B).

Therefore, in order to solve the aforementioned problems, the laundry treating apparatus according to the present invention may further include a lock 70 for fixing (that is, restricting the first switching member or the second switching member) the position of the first switching member 1000 or the second switching member 1100 when the door 4 opens the opening 37 (that is, when the door is detached from the front panel 33).

Hereinafter, the lock 70, which will be described in detail with reference to FIGS. 19 to 22, may be applied to the actuator according to the aforementioned first to fourth embodiments.

(a) of FIG. 18 is a conceptual diagram illustrating an operation method of a conventional actuator, and (b) of FIG. 18 is a conceptual diagram illustrating a normal operation method of an actuator according to the first to fourth embodiments of the present invention.

In more detail, (a) of FIG. 18 is a conceptual diagram illustrating that a user presses an actuator when a pivot shaft is arranged to be higher than a pressing point of the actuator, and (b) of FIG. 18 is a conceptual diagram illustrating that a user presses an actuator when a pivot shaft is arranged to be lower than a pressing point of the actuator.

First of all, referring to (a) of FIG. 18, the pivot shaft 995 is arranged to be higher than the pressing point 998 of the actuator 990. That is, the pressing point 998 is arranged at the first portion 996 of the actuator 990 and at the same time is arranged between the pivot shaft 995 and the bottom 993 of the recessed part 992. Accordingly, when the user presses the pressing point 998 of the actuator 990 to rotate the door 4 along the second rotational direction, the user should press the pressing point 998 by using a fingertip (that is, hand end).

In other words, since the force should be focused on the fingertip to press the actuator in accordance with the related art, more force is required for the fingertip than that required in the embodiment which will be described below.

In this case, there is a risk that the user's nails may be broken in case of a woman user. Also, since the user should press the pressing point 998 by bending his/her finger, inconvenience may occur in that a knuckle 3000 is in contact with one sidewall 3100 of the recessed part 992.

Also, the pressed direction of the pressing point 998 pressed by a fingertip is an oblique-downward direction while being toward the body of the user (see arrow shown in (a) of FIG. 14), and the direction for rotating the door along the second rotational direction is a horizontal direction toward the body of the user. Therefore, inconvenience occurs in that the user should apply the force to two directions (that is, the pressed direction of the pressing point 998 and the direction for pulling the door 4 horizontally toward the body of the user) to rotate the door 4 along the second rotational direction.

In the meanwhile, referring to (b) of FIG. 18, the pivot shaft 995 is arranged to be lower than the pressing point 998 of the actuator 990. That is, the pressing point 998 pressed by the user is arranged to be higher than the pivot shaft 995. For example, the pressing point 998 is arranged at the first portion 996 of the actuator 990 and at the same time is arranged between the pivot shaft 995 and the upper side of the recessed part 992.

Accordingly, when the user presses the pressing point 998 of the actuator 990 to rotate the door 4 along the second rotational direction, the user may press the pressing point 998 by using a middle knuckle (for example, second knuckle or first and second knuckles).

In other words, since the pressing point 998 is pressed by the entire area of the middle knuckle when the actuator is pressed in accordance with the embodiment of the present invention, no force is focused on the fingertip unlike the embodiment described in (a) of FIG. 18.

For example, the pressing point 998 may be pressed through the entire area of the second knuckle. Accordingly, there is no risk that the user's nails may be broken in case of the woman user.

Also, since the user does not need to bend his/her finger unlike the embodiment described in (a) of FIG. 18, there is no inconvenience in that the knuckle 3000 is in contact with one sidewall 3100 of the recessed part 992. That is, when the pressing point 998 is pressed, the knuckle 3000 of the user is not in contact with one sidewall 3100 of the recessed part 992.

Also, the pressed direction of the pressing point 998 pressed by the entire area of the knuckle is the horizontal direction toward the body of the user (see arrow shown in (b) of FIG. 18), and the direction for pulling the door 4 to rotate the door 4 along the second rotational direction is also the horizontal direction toward the body of the user.

That is, in case of the embodiment shown in (a) of FIG. 18, the user should pull the door 4 after pressing the pressing point 998, to rotate the door 4 along the second rotational direction. In contrast, in case of the embodiment shown in (b) of FIG. 18, the user may press the pressing point 998 and at the same time pull the door 4 in the same direction as the pressed direction, to open the door 4 along the second rotational direction.

In other words, the user applies the force to the pressing point 998 and the door 4 along one direction (that is, horizontal direction toward the body of the user) to rotate the door 4 along the second rotational direction.

Therefore, the laundry treating apparatus having the actuator according to the embodiment shown in (b) of FIG. 18 may rotate the door 4 along the second rotational direction in accordance with a more convenient and smooth connection operation than that shown in (a) of FIG. 18. In addition, less force needs to be appliced by a user in comparison to the conventional mechanism.

FIGS. 19 and 20 are diagrams illustrating a lock provided in a first switching member.

As shown in FIG. 19, the lock 70 may include a lock body 710 provided in the door 4 and movable along a thickness direction T of the door 4, a body pressing portion 730 provided in the lock body 710 and exposed to the outside of the door 4 by passing through the inner frame 43, and a switching member fixing part 770 detachably provided in the first switching member 1000 depending on the operation of the lock body 710.

If the lock 70 is provided in the door 4, the outer frame 41 is further provided with a lock body receiving groove 317 in which the lock body 710 is received, the inner frame 43 is further provided with a frame through hole 313 (see FIG. 20) through which the body pressing portion 730 passes, and the first switching member 1000 is further provided with a securing part 617 to which the switching member fixing part 770 is coupled.

The lock body receiving groove 317 is a means for guiding a motion of the lock body 710, and may be provided in a shape of a hollow bar of which surface toward the inner frame 43 is opened.

The lock body receiving groove 317 may be provided anywhere at the outer frame 41 as far as a reciprocating motion of the lock body 710 does not interfere with the first switching member 1000.

FIG. 19 illustrates that the lock body receiving groove 317 is located above the first switching member 1000, wherein a body supporting part 790 elastically supporting the lock body 710 is provided in the lock body receiving groove 317 and provides the lock body 710 with an elastic force for pushing the lock body 710 toward the inner frame 43.

In the meanwhile, if the lock body 710 is provided above the first switching member 1000 based on the height direction H of the door, the switching member fixing part 770 may be provided in a body flange 750 extended from the lock body 710 toward a space between the first switching member 1000 and the outer frame 41.

In other words, as shown in FIG. 20, the body flange 750 may be extended from the lock body 710 toward the lower portion of the door 4 and located between the first switching member 1000 and the outer frame 41, and the switching member fixing part 770 may be provided to be projected from the body flange 750 toward the securing part 617 provided in the first switching member 1000.

The securing part 617 may include a first securing part 617*a* and a second securing part 617*b*, which are provided along a width direction W of the door 4, wherein the distance from a first free end 1000*e* of the first switching member to the second securing part 617*b* is preferably longer than the distance from the first free end 1000*e* of the first switching member to the first securing part 617*a*.

Each of the securing parts 617*a* and 617*b* may include a securing hole provided to pass through the first switching member 1000 or a securing groove provided as the first switching member 1000 is bent concavely. FIGS. 19 and 20 illustrate that the securing part is provided with a securing hole in accordance with one embodiment.

The switching member fixing part 770 may include a first fixing projection 771 projected from the body flange 750, wherein the first fixing projection 771 may be inserted into any one of the first securing part 617*a* and the second securing part 617*b* depending on the position of the first switching member 1000. That is, if each of the first securing part 617*a* and the second securing part 617*b* has a width w1 equally, a width w2 of the first fixing projection 771 is less than the width w1 of the securing part.

In the meanwhile, the distance of the first switching member 1000 moving along the width direction W of the door 4 is varied depending on a pressed level of the pressing point 998 pressed by the user. Therefore, if the switching member fixing part 770 is provided with the first fixing projection 771 only, a problem may occur in that the first fixing projection 771 is not coupled to any one of the securing parts 617*a* and 617*b* as the user does not press the pressing point 998 of the actuator 990 within a sufficient range.

In order to solve the problem, the lock 70 provided in the present invention may include a second fixing projection 773 provided in the first fixing projection 771, wherein the second fixing projection 773 has a width w3 smaller than the width w2 of the first fixing projection 771.

If the second fixing projection 773 is provided at a corner (that is, corner toward the first hinge 5) toward the first free end 1000*e* of the first switching member on a center upper surface of the first fixing projection 771 or an upper surface of the first fixing projection 771, the moving distance of the first switching member 1000, which is required for the first securing part 617*a* to move to the upper portion of the second fixing projection 773 located below the second securing part 617*b*, is shorter than the moving distance of the first switching member 1000, which is required for the first securing part 617*a* to move to the upper portion of the first fixing projection 771 located below the second securing part 617*b*.

Therefore, if the second fixing projection 773 having the width w3 smaller than the width w2 of the first fixing projection 771 is provided in the first fixing projection 771, the position of the switching member fixing part 770 may be switched from the second securing part 617*b* to the first securing part 617*a* even though the pressing point 998 of the actuator 990 is pressed a little, whereby the switching member fixing part 770 may easily be coupled to the securing part 617.

A procedure of opening the opening 37 through the door 4 provided with the lock 70 and a switching procedure of a pivot will be described as follows.

As shown in (b) of FIG. 20, if the door 4 rotating through the second pivot (B) closes the opening 37, the body pressing portion 730 is pressed by the front panel 33, whereby the lock body 710 is moved from the lock body receiving groove 317 toward the outer frame 41. At this time, the elastic supporting part 790 is compressed by the lock body 710.

If the lock body 710 is moved from the lock body receiving groove 317 toward the outer frame 41, the switching member fixing part 770 is detached from the first securing part 617*a*, and the first switching member 1000 is moved toward the first hinge 5 by the first elastic member 1030.

If the first switching member 1000 is moved toward the first hinge 5 by the first elastic member 1030, the second securing part 617*b* is located above the switching member fixing part 770, the first free end 1000*e* of the first switching member 1000 prevents the first shaft 51 from being detached from the first receiving groove 531, and the first free end 1100*e* of the second switching member 1100 is detached from the guide groove 732.

In this state, if the user pulls the door 4 by putting his/her hand in the recessed part 992 or pulls the side grip 980, without pressing the pressing point 998 of the actuator 990, the door 4 is rotated based on the first pivot (A).

If the door 4 starts to be rotated based on the first pivot (A), a contact state between the body pressing portion 730 and the front panel 33 is released, whereby an outer force pressing the body pressing portion 730 toward the outer frame 41 is removed.

Therefore, the lock body 710 is moved toward the inner frame 43 by a restoring force of the elastic supporting part 790, and then the switching member fixing part 770 is inserted into the second securing part 617*b*.

If the switching member fixing part 770 is inserted into the second securing part 617*b*, the position of the first switching member 1000 is fixed, whereby the first shaft 5 is not detached from the first receiving groove 531 even though the user presses the pressing point 998 of the actuator 990 while the door 4 is being rotated through the first pivot (A).

In the meanwhile, if the door 4 rotating through the first pivot (A) closes the opening 37, the body pressing portion 730 is pressed by the front panel 33, and the lock body 710 is moved from the lock body receiving groove 317 toward the outer frame 41. Therefore, the switching member fixing part 770 is detached from the second securing part 617*b* (that is, restriction of the first switching member 1000 is released).

In this state, if the user presses the actuator 990, a second free end 1000*f* of the first switching member 1000 pushes the inclined surface 1101 provided at a second free end 1100*f* of the second switching member 1100. Therefore, the first free end 1000*e* of the first switching member opens the first receiving groove 531 such that the first shaft 51 may be detached from the first receiving groove 531, and the first free end 1100*e* of the second switching member is inserted into the guide groove 732, and the first securing part 617*a* is located at the front of the switching member fixing part 770.

At this time, if the user pulls the door 4 in a state that the actuator 990 is pressed by the user, the door 4 starts to be rotated based on the second pivot (B).

If the door 4 starts to be rotated based on the second pivot (B), the contact state between the body pressing portion 730 and the front panel 33 is released. If the outer force pressing the body pressing portion 730 toward the outer frame 41 is removed, the switching member fixing part 770 is inserted into the first securing part 617*a*, whereby the state of the second switching member 1100 pressed by the first switching member 1000 is maintained.

Therefore, in the present invention, the fourth shaft 714 may be prevented from being detached from the fourth shaft detachable part 73 (that is, the second receiving groove 731) during rotation of the door 4 even though the pressing point 998 of the actuator 990 is not pressed when the door 4 is rotated through the second pivot (B).

In the meanwhile, although the aforementioned lock 70 is based on that the switching member fixing part 770 is provided to fix the position of the first switching member 1000, the lock 70 provided in the present invention may be provided to fix the position of the second switching member 1100.

In this case, the first securing part 617*a* and the second securing part 617*b* should be provided in the second switching member 1100, and the distance from the first free end 1100*e* of the second switching member to the first securing part is shorter than the distance from the first free end 1100*e* to the second securing part. Therefore, if the switching member fixing part 770 is coupled to the first securing part, the door 4 is coupled to the first pivot (A), and if the switching member fixing part 770 is coupled to the second securing part, the door 4 is coupled to the second pivot (B).

FIGS. 21 and 22 are diagrams illustrating another example of a lock.

In other words, FIG. 21 illustrates that the aforementioned lock 70 is provided to fix the actuator 990, and FIG. 22 illustrates that the body pressing portion 730 may perform a reciprocating motion along the thickness direction T of the door. If the lock 70 is provided to fix the actuator 990, the actuator 990 may include a first body securing part 451 to which the lock 70 is detachably coupled, and a second body securing part 453 located below the first body securing part 451, wherein the first body securing part 451 and the second securing part 453 may be provided to be located on a circular arc having a body rotational shaft 430 as a center shaft.

As shown in FIGS. 21 and 22, the lock 70 according to this embodiment may include a lock body 710 provided to enable a reciprocating motion along the width direction W of the door 4 and inserted into each of the first body securing part 451 and the second body securing part 453, a body supporting part 790 elastically supporting the lock body 710 and pressing the lock body 710 toward the direction where the actuator 990 is located, a body inclined surface 720 provided in the lock body 710, and a body pressing portion 730 moving the lock body 710 by being in contact with the body inclined surface 720 if the door 4 closes the opening 37.

The body pressing portion 730 may be provided in the door 4 to enable the reciprocating motion along the thickness direction T of the door, or may be provided in the front panel 33 to press the body inclined surface 720 when the door 4 closes the opening 37.

FIG. 22 illustrates that the body pressing portion 730 may perform the reciprocating motion along the thickness direction T of the door.

The door 4 may further include a pressing portion guider 318 guiding the reciprocating motion of the body pressing portion 730. The pressing portion guider 318 should be provided so as not to interfere with the pivot switching member, and is located above the first switching member 1000 as shown in FIG. 22.

In the meanwhile, the body pressing portion 730 may include a first body pressing portion 740 provided to be projected from the body pressing portion 730 toward the body inclined surface 720, and a second body pressing portion 780 projected from the body pressing portion 730 toward the front panel 33.

In this case, if the door 4 closes the opening 37, the second body pressing portion 780 is pressed by the front panel 33. Therefore, the first body pressing portion 740 may move the lock body 710 to be far away from the actuator 990 by being in contact with the body inclined surface 720 ((a) of FIG. 22).

In the meanwhile, if the door 4 opens the opening 37, the outer force applied to the second body pressing portion 780 is removed. Therefore, the lock body 710 is moved toward the actuator 990 by the body supporting part 790, and the first body pressing portion 740 is moved toward the inner frame 43 by the body inclined surface 720, whereby the second body pressing portion 780 is restored to the state (initial position, (b) of FIG. 22) that the second body pressing portion 780 is exposed to the outside of the inner frame 43.

In order to assist restoration of the body pressing portion 730 to the initial position, the door 4 may further include a pressing portion support (not shown) elastically supporting the body pressing portion 730.

In this embodiment, the first switching member 1000 prevents the first shaft 51 from being detached from the first receiving groove 531 when the door 4 closes the opening 37, and the lock body 710 does not restrict the actuator 990 (the lock body 710 is not inserted into the first body securing part 451, (a) of FIG. 22).

However, if the door 4 is rotated based on the first pivot (A) to open the opening, the outer force applied to the second body pressing portion 780 is removed, whereby the free end of the lock body 710 is inserted into the first body securing part 451 by the body supporting part 790.

Therefore, in this embodiment, the actuator 990 is operated when the door 4 is rotated based on the first pivot (A), whereby the first shaft 51 may be prevented from being detached from the first receiving groove 531.

In the meanwhile, if the door 4 is rotated based on the second pivot (B), the free end of the lock body 710 is coupled to the second body securing part 453 and thus restricts the actuator 990.

In order that the door 4 is rotated based on the second pivot (B), the user should move the first switching member 1000 through the actuator 990 such that the second switching member 1100 is pressed.

As described above, since the second body securing part 453 is provided on the circumference, which has the body rotational shaft 430 as a center shaft and passes through the first body securing part 451, below the first body securing part 451, if the user rotates the actuator 990, the first body securing part 451 strays from a reciprocating motion path of the lock body 710, and the second body securing part 453 is located on the reciprocating motion path of the lock body 710.

In this state, if the user detaches the door 4 from the front panel 33, the free end of the lock body 710 is moved toward the actuator 990 and then inserted into the second body securing part 453.

Therefore, in this embodiment, the actuator 990 is operated while the door 4 is being rotated based on the second pivot (B), whereby the fourth shaft may be prevented from being detached from the second receiving groove 731.

(b) of FIG. 21 illustrates that the first body securing part 451 and the second body securing part 453 are provided in a shape of a hole passing through the actuator 990 or a groove formed as the surface of the actuator 990 is bent concavely.

However, the first body securing part 451 and the second body securing part 453 may be provided in various structures to implement the aforementioned function. FIG. 21(*c*) illustrates that at least one of the first body securing part 451 and the second body securing part 453 is provided at the corner of the actuator 990 in a shape of a groove.

Moreover, the lock 70 provided in the present invention may include a body pressing portion 730, a first body pressing portion 740 provided to be projected from the body pressing portion 730 toward the body inclined surface 720, and a second body pressing portion 780 provided in the front panel 33, pressing the first body pressing portion 740 toward the body inclined surface 720 when the door 4 closes the opening.

In this case, the inner frame 43 of the door 4 should include an insertion hole to which the second body pressing portion 790 is inserted when the door 4 closes the opening 37, and the body pressing portion 730 should be provided to be in contact with the second body pressing portion 780 when the second body pressing portion 780 is inserted into the insertion hole.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

The invention claimed is:

1. An apparatus comprising:

a cabinet that forms a profile, provided with an opening;

a door having an inner frame arranged toward the opening and an outer frame coupled to the inner frame and arranged toward the outside of the cabinet, the door being configured to open and close the opening;

a hinge part having a first pivot that rotates the door along a first rotational direction and a second pivot that rotates the door along a second rotational direction different from the first rotational direction;

a pivot switching member movable to rotatably fix the door to any one of the first pivot and the second pivot; and an actuator provided in the door and configured to be pressed by a user, moving the pivot switching member when being pressed by the user, wherein the actuator includes a pressing point pressed by the user, and the pressing point is provided at an upper end of the actuator, wherein the actuator includes a first actuator configured to be pressed by the user, and a second actuator configured to be pressed by the first actuator when the first actuator is pressed by the user, wherein the first actuator pivots around a first pivot shaft, and the second actuator includes a first portion arranged in a recess that is formed at an upper end of the door, and a second portion that extends from an end of the first portion toward the inner frame of the door and pivots around a second pivot shaft when pressed by the first actuator so as to move the pivot switching member, wherein the first actuator includes a projection that projects toward the first portion of the second actuator, and the first portion of the second actuator is pressed by the projection when the first actuator is pressed by the user, and wherein a pressing portion that projects toward the pivot switching member is formed at one end of the second portion of the second actuator, and when the first actuator is pressed by the user, the second portion and the pressing portion are moved in the same as the pressed direction of the first actuator.

2. The apparatus according to claim 1, wherein the recess is recessed at a predetermined depth along a horizontal extension direction of the door, and the pressing point is arranged to be higher than the pivot shaft.

3. The apparatus according to claim 2, wherein the pivot switching member is provided with an inclined surface configured to move the pivot switching member in accordance with pressurization of the second actuator.

4. The apparatus according to claim 3, wherein the pivot switching member is provided with a bent portion bent to surround at least a part of the pressing portion, and wherein the inclined surface is formed at one side of the bent portion and arranged to be in contact with the pressing portion.

5. The apparatus according to claim 4, wherein the bent portion is formed to surround at least a part of the pressing portion in a horizontal direction.

6. The apparatus according to claim 2, wherein the pivot switching member is provided with a projection that projects toward the inner frame, and the inclined surface is formed at one side of the projection and arranged in contact with the pressing portion.

7. The apparatus according to claim 6, wherein the projection is tapered such that a horizontal width increases as a distance between the projection and the pivot switching member increases.

8. The apparatus according to claim 2, wherein, when the first portion of the second actuator is pressed, at least a part of the outer frame arranged in the pressed direction of the second actuator is formed to be rotated in the pressed direction of the second actuator.

9. The apparatus according to claim 2, wherein the pivot switching member includes a first switching member movable along a width direction of the door and a second switching member movable along a height direction of the door, and wherein the first switching member is arranged between the outer frame and the second portion of the second actuator.

10. The apparatus according to claim 1, wherein the first pivot shaft is provided at a lower end of the first actuator, and the second pivot shaft is provided at an upper end of the second actuator.

11. The apparatus according to claim 10, wherein the first pivot shaft of the first actuator is arranged to be lower than the second pivot shaft of the second actuator.

12. The apparatus according to claim 1, wherein the projection is fixed to the first portion of the second actuator.

13. The apparatus according to claim 1, wherein, when the first actuator is pressed, a free end of the second portion of the second actuator is moved in the same direction as the pressed direction of the first actuator.

14. The apparatus according to claim 13, wherein the pressing portion bent toward the outer frame is provided at the free end of the second portion of the second actuator.

15. The apparatus according to claim 14, wherein the pivot switching member includes a first switching member movable along a width direction of the door and a second switching member movable along a height direction of the door, and the pressing portion is formed to be projected toward an inclined surface of a projection piece formed in the first switching member.

* * * * *